US010151262B2

(12) United States Patent
Miyamoto et al.

(10) Patent No.: US 10,151,262 B2
(45) Date of Patent: Dec. 11, 2018

(54) ABNORMALITY DIAGNOSIS SYSTEM OF AIR-FUEL RATIO SENSORS

(71) Applicant: TOYOTA JIDOSHA KABUSHIKI KAISHA, Toyota-shi, Aichi-ken (JP)

(72) Inventors: Hiroshi Miyamoto, Shizuoka (JP); Yasushi Iwazaki, Ebina (JP); Toru Kidokoro, Hadano (JP); Yuji Miyoshi, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 103 days.

(21) Appl. No.: 15/038,133

(22) PCT Filed: Nov. 20, 2014

(86) PCT No.: PCT/JP2014/081483

§ 371 (c)(1),
(2) Date: May 20, 2016

(87) PCT Pub. No.: WO2015/076421

PCT Pub. Date: May 28, 2015

(65) Prior Publication Data

US 2016/0290266 A1 Oct. 6, 2016

(30) Foreign Application Priority Data

Nov. 25, 2013 (JP) ..... 2013-243188

(51) Int. Cl.
*F02D 41/14* (2006.01)
*F02D 41/12* (2006.01)
*F02D 41/22* (2006.01)

(52) U.S. Cl.
CPC ..... *F02D 41/1454* (2013.01); *F02D 41/123* (2013.01); *F02D 41/1441* (2013.01);
(Continued)

(58) Field of Classification Search
CPC . F02D 41/123; F02D 41/1495; F02D 41/1454
See application file for complete search history.

(56) References Cited

U.S. PATENT DOCUMENTS 5,414,996 A 5/1995 Sawada et al.
5,845,489 A 12/1998 Dohta et al.
(Continued)

FOREIGN PATENT DOCUMENTS

DE 196 55 340 B4 8/2007
EP 1 724 458 A1 11/2006
(Continued)

*Primary Examiner* — Mark Laurenzi
*Assistant Examiner* — Jason Sheppard
(74) *Attorney, Agent, or Firm* — Hunton Andrews Kurth LLP

(57) ABSTRACT

An internal combustion engine comprises an exhaust purification catalyst arranged in an exhaust passage of the internal combustion engine; an upstream side air-fuel ratio sensor for detecting an air-fuel ratio of exhaust gas flowing into the exhaust purification catalyst; and a downstream side air-fuel ratio sensor for detecting an air-fuel ratio of exhaust gas flowing out from the exhaust purification catalyst. An abnormality diagnosis system of air-fuel ratio sensors judges that at least one of the air-fuel ratio sensors has become abnormal when a difference or ratio between an output value of said upstream side air-fuel ratio sensor and an output value of said downstream side air-fuel ratio sensor becomes outside a predetermined range of normal difference or predetermined range of normal ratio during atmospheric gas introduction control where the exhaust gas flowing into the exhaust purification catalyst becomes atmospheric gas.

2 Claims, 16 Drawing Sheets

(52) U.S. Cl.
CPC ..... *F02D 41/1495* (2013.01); *F02D 41/222* (2013.01); *F02D 41/1456* (2013.01)

(56) References Cited

U.S. PATENT DOCUMENTS

| | | | | |
|---|---|---|---|---|
| 6,494,038 | B2 * | 12/2002 | Kobayashi | F02D 41/0295 60/274 |
| 2006/0260295 | A1 | 11/2006 | Gielen | |
| 2008/0276698 | A1 | 11/2008 | Toya | |
| 2009/0003405 | A1 | 1/2009 | Corbet et al. | |
| 2009/0139210 | A1 | 6/2009 | Sanchez | |
| 2012/0029792 | A1 * | 2/2012 | Iwazaki | F02D 41/1441 701/104 |
| 2012/0192634 | A1 * | 8/2012 | Aoki | G01M 15/104 73/114.72 |
| 2015/0025778 | A1 | 1/2015 | Matsuoka et al. | |

FOREIGN PATENT DOCUMENTS

| | | | |
|---|---|---|---|
| JP | H05-133264 | A | 5/1993 |
| JP | H06-280662 | A | 10/1994 |
| JP | H08-189402 | A | 7/1996 |
| JP | 2008-169776 | A | 7/2008 |
| JP | 2010-007534 | A | 1/2010 |
| JP | 2010-180717 | A | 8/2010 |
| JP | 2011-506912 | A | 3/2011 |
| JP | 2013-178227 | A | 9/2013 |
| WO | 2010/109946 | A1 | 9/2010 |

* cited by examiner

ABNORMALITY DIAGNOSIS SYSTEM OF AIR-FUEL RATIO SENSORS

CROSS-REFERENCE TO RELATED APPLICATIONS

This is a national phase application based on the PCT International Patent Application No. PCT/JP2014/081483 filed Nov. 20, 2014, claiming priority to Japanese Patent Application No. 2013-243188 filed Nov. 25, 2013, the entire contents of both of which are incorporated herein by reference.

TECHNICAL FIELD

The present invention relates to an abnormality diagnosis system of air-fuel ratio sensors.

BACKGROUND ART

Known in the past has been an exhaust purification system which provides with an air-fuel ratio sensor at an upstream side, in the exhaust flow direction, of an exhaust purification catalyst provided in an exhaust passage of the internal combustion engine, and provides with an oxygen sensor at a downstream side of the exhaust purification catalyst in the exhaust flow direction. In such an exhaust purification system, for example, the amount of fuel fed to the internal combustion engine is controlled by feedback based on the output of the upstream side air-fuel ratio sensor such that the air-fuel ratio of the exhaust gas flowing into the exhaust purification catalyst becomes a target air-fuel ratio (main feedback control) and the target air-fuel ratio is controlled by feedback based on the output of the downstream side oxygen, sensor (sub feedback control).

In the above-mentioned feedback control, the output values of the upstream side air-fuel ratio sensor and downstream side oxygen sensor are utilized. For this reason, if abnormalities in these air-fuel ratio sensor and oxygen sensor, cause large error to occur in their output values, feedback control becomes unable to be suitably performed. For this reason, an abnormality diagnosis system which diagnoses an upstream side air fuel ratio sensor and a downstream side oxygen sensor for abnormality has been proposed (for example, PLT 1).

For example, in the abnormality diagnosis system described in PLT 1, during operation of the internal combustion engine, abnormality of the oxygen sensor is diagnosed based on the response time from when starting fuel cut control which stops feed of fuel to the internal combustion engine to when the downstream side oxygen sensor changes in output value. In particular, when this response time is an abnormality judgment value or more, it is considered that the oxygen sensor has fallen in responsivity and it is judged that the oxygen sensor has become abnormal.

On the other hand, an exhaust purification catalyst also deteriorates the longer that it is used. If the exhaust purification catalyst deteriorates in this way, it is known that along with this, the exhaust purification catalyst decreases in maximum storable oxygen amount. For this reason, by detecting the maximum storable oxygen amount of the exhaust purification catalyst, it is possible to detect the degree of deterioration of the exhaust purification catalyst. As the method of detection of this maximum storable oxygen amount, for example, active air-fuel ratio control in which the air-fuel ratio of the exhaust gas flowing into the exhaust purification catalyst is alternately switched between the rich air-fuel ratio and the lean air-fuel ratio is known. In this method, the maximum storable oxygen amount of the exhaust purification catalyst is estimated based on the output of the downstream side oxygen sensor, which changes along with active air-fuel ratio control (for example, PLT 2).

CITATIONS LIST

Patent Literature

PLT 1: Japanese Patent Publication No. 2008-169776A
PLT 2: Japanese Patent Publication No. 5-133264A
PLT 3: Japanese Patent Publication No. 2010-180717A
PLT 4: Japanese Patent Publication No. 2011-506912A

SUMMARY OF INVENTION

Technical Problem

In the meantime, as the method of diagnosis of abnormality of air-fuel ratio sensors, the method of using the output values of the individual air-fuel ratio sensors during fuel cut control may be considered. In such a method, specifically, during fuel cut control, when the output value of an air-fuel ratio sensor is within a predetermined range of normal judgment, it is judged that the corresponding air-fuel ratio sensor is normal. On the other hand, if the output value of the air-fuel ratio sensor is outside the range of normal judgment, it is judged that the air-fuel ratio sensor has become abnormal.

When performing an abnormality judgment of air-fuel ratio sensors in this way, due to the fuel cut control, the exhaust gas flowing around the air-fuel ratio sensors becomes atmospheric gas. For this reason, during fuel cut control, the outputs of the air-fuel ratio sensors become output values corresponding to the atmospheric gas, and therefore the values become always substantially the same so long as the air-fuel ratio sensors do not become abnormal.

However, the output values of air-fuel ratio sensors change in accordance with the pressure of the exhaust gas flowing around them even if the exhaust gas is constant in air-fuel ratio. In general, the higher the pressure of the exhaust gas flowing around the air-fuel ratio sensors, the larger the output values of the air-fuel ratio sensors. In fuel cut control, the pressure of the exhaust gas flowing around the air-fuel ratio sensors becomes proportional to the atmospheric pressure around the vehicle which mounts the internal combustion engine, and therefore the higher the atmospheric pressure, the larger the output values of the air-fuel ratio sensors become. Therefore, the above-mentioned range of normal judgment had to be set wide considering the change in the output values of the air-fuel ratio sensors corresponding to the atmospheric pressure. However, if setting this range of normal judgment wide, there was the problem that the judgment of abnormality of the air-fuel ratio sensors becomes delayed.

Further, as explained above, when diagnosing an exhaust purification catalyst for deterioration, it is necessary to estimate the maximum storable oxygen amount of the exhaust purification catalyst. The maximum storable oxygen amount is estimated, for example, in the following way using air-fuel ratio sensors at the upstream side and downstream side of the exhaust purification catalyst in the exhaust flow direction. That is, first, a feedback control is performed based on the output of the upstream side air-fuel ratio sensor so that the air-fuel ratio of the exhaust gas flowing into the exhaust purification catalyst becomes the stoichiometric air-fuel ratio. Further, if the air-fuel ratio detected by the downstream side air-fuel ratio sensor becomes a rich judgment air-fuel ratio which is slightly richer than the stoichiometric air-fuel ratio, the target air-fuel ratio is changed to an air-fuel ratio which is leaner than the stoichiometric air-fuel ratio (below, also referred to as the "lean air-fuel ratio"). While the target air-fuel ratio is the lean air-fuel ratio, the amount of oxygen flowing into the exhaust purification catalyst is cumulatively added whereby the stored amount of oxygen of the exhaust purification catalyst is calculated. After that, when the air-fuel ratio detected by the downstream side oxygen sensor becomes a lean judgment air-fuel ratio which is slightly leaner than the stoichiometric air-fuel ratio, the cumulative value of the amount of oxygen up to that time is calculated as the maximum storable oxygen amount.

Even when estimating the maximum storable oxygen amount in this way, as explained above, if the range of normal judgment is set wide, it is not possible to suitably estimate the amount. For example, when an abnormality of the upstream side air-fuel ratio sensor causes error in its output value and thus its absolute value is output larger than its actual value, due to the above-mentioned feedback control, the actual air-fuel ratio of the exhaust gas flowing into the exhaust purification catalyst becomes closer to the stoichiometric air-fuel ratio rather than the target air-fuel ratio. On the other hand, when an abnormality of the downstream side air-fuel ratio sensor causes error in its output value and thus its absolute value is output smaller than its actual value, the output value of the downstream side air-fuel ratio sensor becomes a value corresponding to an air-fuel ratio closer to the stoichiometric air-fuel ratio than the actual air-fuel ratio of the exhaust gas flowing out from the exhaust purification catalyst.

If the abnormalities of these two air-fuel ratio sensors occur simultaneously, when the target air-fuel ratio is the lean air-fuel ratio, the actual air-fuel ratio of the exhaust gas flowing into the exhaust purification catalyst becomes an air-fuel ratio richer than the target air-fuel ratio (air-fuel ratio closer to stoichiometric air-fuel ratio). In addition, the air-fuel ratio detected by the downstream side air-fuel ratio sensor becomes an air-fuel ratio which is further richer than that (air-fuel ratio closer to stoichiometric air-fuel ratio). As a result, even if lean air-fuel ratio exhaust gas flows out from the exhaust purification catalyst, the air-fuel ratio detected by the downstream side air-fuel ratio sensor becomes smaller than the lean judgment air-fuel ratio. For this reason, the downstream side air-fuel ratio sensor does not reach the lean judgment air-fuel ratio and, as a result, the maximum storable oxygen amount can no longer be calculated.

Therefore, considering the above problem, an object of the present invention is to provide an abnormality diagnosis system which can quickly and suitably diagnose air-fuel ratio sensors for abnormality.

Solution to Problem

To solve the above problem, in a first aspect of the invention, there is provided an abnormality diagnosis system of air-fuel ratio sensors which is used in an internal combustion engine, the internal combustion engine comprising an exhaust purification catalyst arranged in an exhaust passage of the internal combustion engine; an upstream side air-fuel ratio sensor which is arranged at an upstream side of said exhaust purification catalyst in an exhaust flow direction and which detects an air-fuel ratio of exhaust gas flowing into said exhaust purification catalyst; and a downstream side air-fuel ratio sensor which is arranged at a downstream side of said exhaust purification catalyst in an exhaust flow direction and which detects an air-fuel ratio of exhaust gas flowing out from said exhaust purification catalyst, wherein the abnormality diagnosis system judges that at least one of the air-fuel ratio sensors has become abnormal when a difference or ratio between an output value of said upstream side air-fuel ratio sensor and an output value of said downstream side air-fuel ratio sensor becomes outside a predetermined range of normal difference or predetermined range of normal ratio during fuel cut control.

In a second aspect of the invention, the abnormality diagnosis system judges that an air-fuel ratio has become abnormal when the output value of the air-fuel ratio sensor is outside a predetermined range of normal judgment during fuel cut control.

In a third aspect of the invention, said range of normal difference is set narrower than said range of normal judgment.

In a fourth aspect of the invention, when the difference or ratio of the output values of the two air-fuel ratio sensors is within said range of normal difference or said range of normal ratio and it is diagnosed that one of said upstream side air-fuel ratio sensor and said downstream side air-fuel ratio sensor has become abnormal, the abnormality diagnosis system judges that the other of the air-fuel ratio sensors has also become abnormal.

Advantageous Effects of Invention

According to the first aspect of the invention, there is provided an abnormality diagnosis system which can quickly and suitably diagnose air-fuel ratio sensors for abnormality.

DESCRIPTION OF EMBODIMENTS

Figure 1:
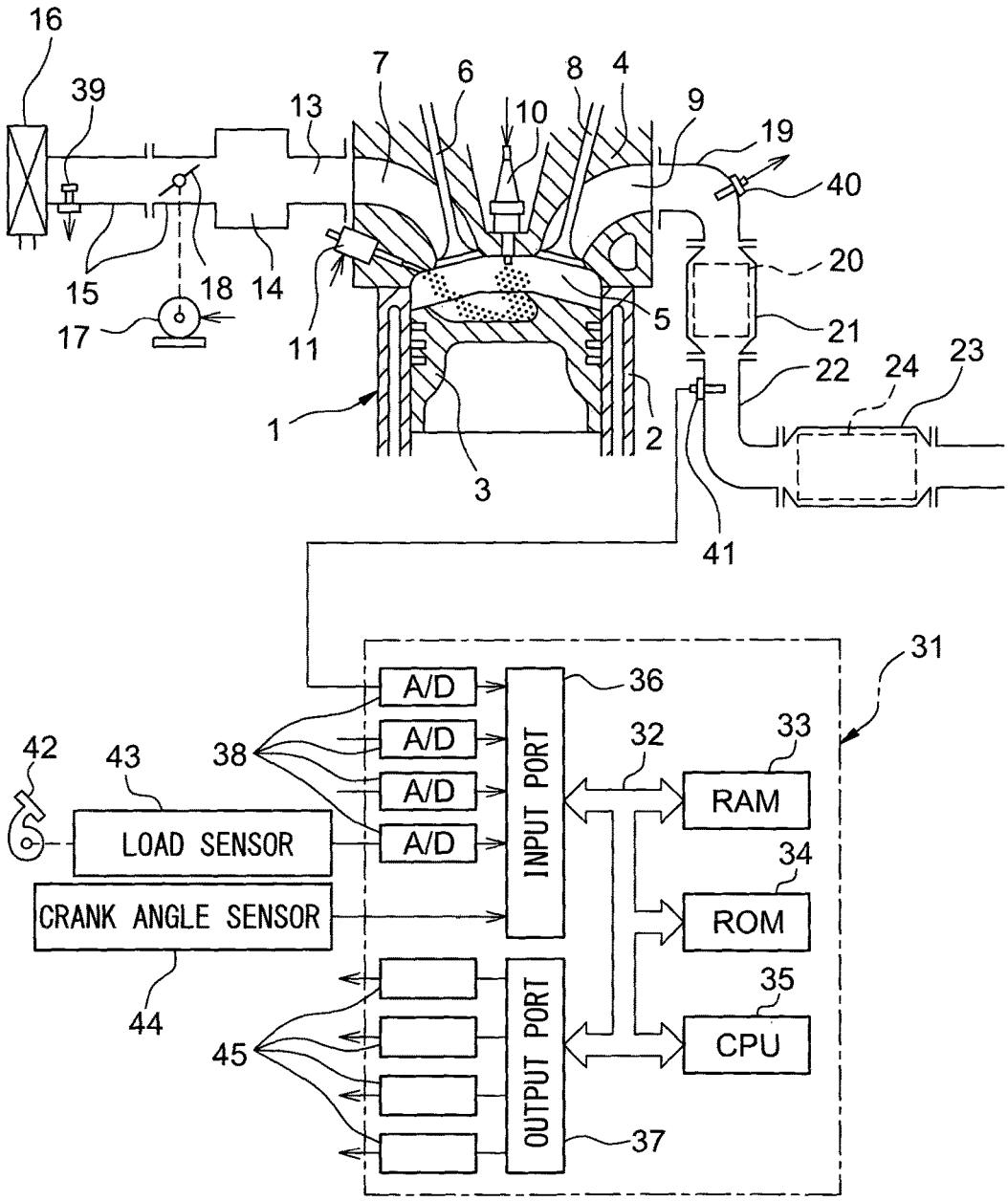
FIG. 1 is a view which schematically shows an internal combustion engine in which an abnormality diagnosis system of the present invention is used.

Below, referring to the drawings, an abnormality diagnosis system of an air-fuel ratio sensor of the present invention will be explained in detail. Note that, in the following explanation, similar component elements are assigned the same reference numerals.

<Explanation of Internal Combustion Engine as a Whole>

FIG. 1 is a view which schematically shows an internal combustion engine in which an abnormality diagnosis system according to a first embodiment of the present invention is used. In FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present invention may also use another fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 consists of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, the ECU 31 functions as a control system for controlling the internal combustion engine and an abnormality diagnosis system for diagnosing the abnormality in the air-fuel ratio sensors 40 and 41.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have a number of cylinders, cylinder array, way of fuel injection, configuration of intake and exhaust systems, configuration of valve mechanism, presence of supercharger, and/or supercharging way, etc. which are different from the above internal combustion engine.

<Explanation of Exhaust Purification Catalyst>

The upstream side exhaust purification catalyst 20 and downstream side exhaust purification catalyst 24 have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_x$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

Figure 2A:
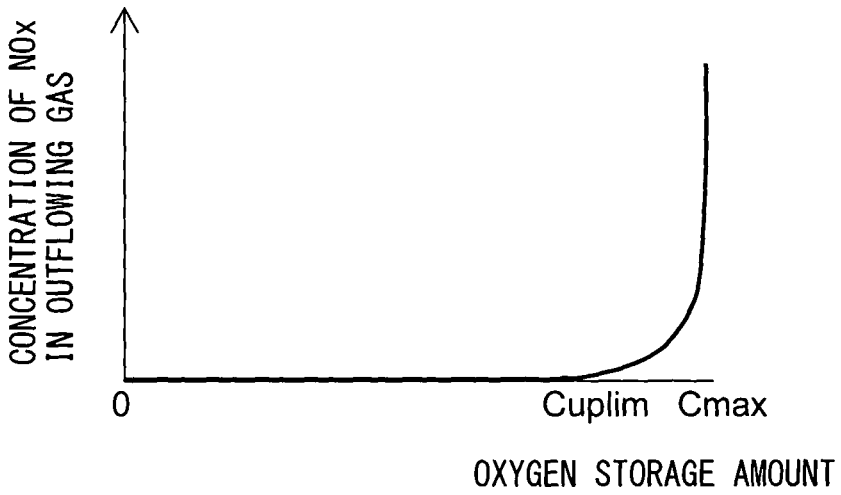
FIGS. 2A and 2B are views which show the relationship between a stored amount of oxygen of the exhaust purification catalyst and a concentration of $NO_x$ or concentration of HC or CO in the exhaust gas flowing out from the exhaust purification catalyst.

The exhaust purification catalysts 20 and 24 have a catalytic action and oxygen storage ability and thereby have the action of purifying $NO_x$ and unburned gas according to the stored amount of oxygen. That is, as shown on solid line in FIG. 2A, in the case where the air-fuel ratio of the exhaust gas flowing into the exhaust purification catalysts 20 and 24 is a lean air-fuel ratio, when the stored amount of oxygen is small, the exhaust purification catalysts 20 and 24 store the oxygen in the exhaust gas. Further, along with this, the $NO_x$ in the exhaust gas is reduced and purified. On the other hand, if the stored amount of oxygen becomes larger beyond a certain stored amount near the maximum storable oxygen amount Cmax (in the figure, Cuplim), the exhaust gas flowing out from the exhaust purification catalysts 20 and 24 rises in concentration of oxygen and $NO_x$.

Figure 2B:
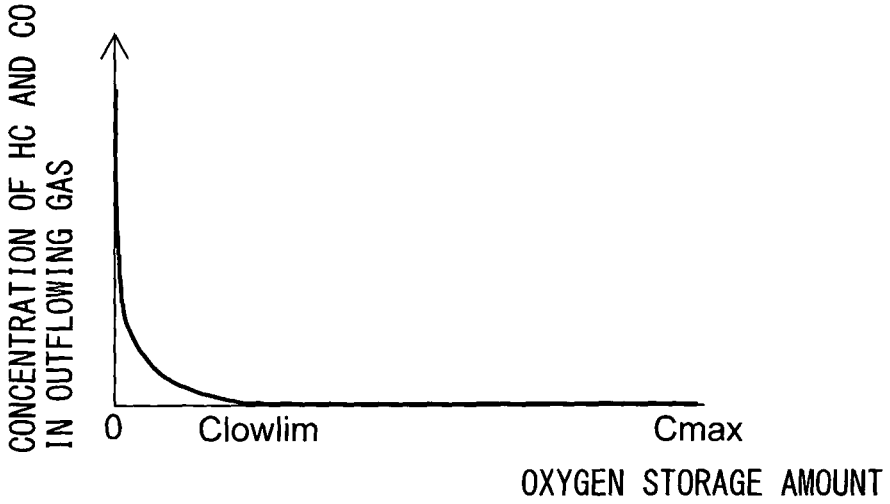

On the other hand, as shown on solid line in FIG. 2B, in the case where the air-fuel ratio of the exhaust gas flowing into the exhaust purification catalysts 20 and 24 is the rich air-fuel ratio, when the stored amount of oxygen is large, the oxygen stored in the exhaust purification catalysts 20 and 24 is released, and the unburned gas in the exhaust gas is oxidized and purified. On the other hand, if the stored amount of oxygen becomes small, the exhaust gas flowing out from the exhaust purification catalysts 20 and 24 rapidly rises in concentration of unburned gas at a certain stored amount near zero (in the figure, Cdwnlim).

In the above way, according to the exhaust purification catalysts 20 and 24 used in the present embodiment, the purification characteristics of $NO_x$ and unburned gas in the exhaust gas change depending on the air-fuel ratio and stored amount of oxygen of the exhaust gas flowing into the exhaust purification catalysts 20 and 24. Note that, if having a catalytic action and oxygen storage ability, the exhaust purification catalysts 20 and 24 may also be catalysts different from three-way catalysts.

<Configuration of Air-Fuel Ratio Sensor>

Figure 3:
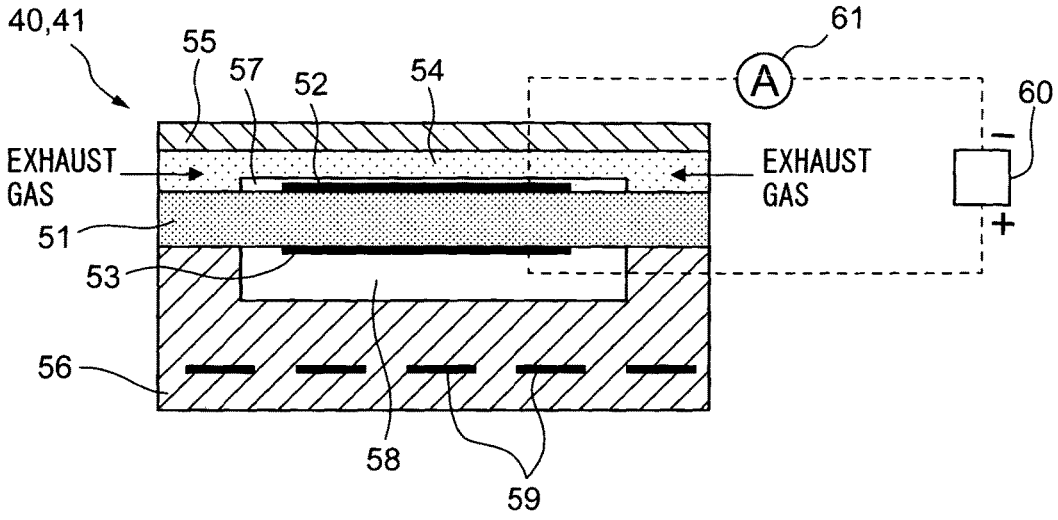
FIG. 3 is a schematic cross-sectional view of an air-fuel ratio sensor.

Next, referring to FIG. 3, the configurations of air-fuel ratio sensors 40 and 41 in the present embodiment will be explained. FIG. 3 is a schematic cross-sectional view of air-fuel ratio sensors 40 and 41. As will be understood from FIG. 3, the air-fuel ratio sensors 40 and 41 in the present embodiment are single-cell type air-fuel ratio sensors each having a single cell which comprises a solid electrolyte layer and a pair of electrodes. Note that, in this embodiment, the air-fuel ratio sensor having the same configurations is used as both air-fuel ratio sensors 40 and 41.

As shown in FIG. 3, each of the air-fuel ratio sensors 40 and 41 comprises a solid electrolyte layer 51, an exhaust side electrode 52 arranged at one side surface of the solid electrolyte layer 51, an atmosphere side electrode 53 arranged at the other side surface of the solid electrolyte layer 51, a diffusion regulation layer 54 which regulates the diffusion of the passing exhaust gas, a protective layer 55 for protecting the diffusion regulation layer 54, and a heater part 56 for heating the air-fuel ratio sensor 40 or 41.

On one side surface of the solid electrolyte layer 51, a diffusion regulation layer 54 is provided. On the side surface of the diffusion regulation layer 54 at the opposite side from the side surface of the solid electrolyte layer 51 side, a protective layer 55 is provided. In the present embodiment, a measured gas chamber 57 is formed between the solid electrolyte layer 51 and the diffusion regulation layer 54. The exhaust side electrode 52 is arranged in the measured gas chamber 57, and the exhaust gas is introduced through the diffusion regulation layer 54 into the measured gas chamber 57. On the other side surface of the solid electrolyte layer 51, the heater part 56 having heaters 59 is provided. Between the solid electrolyte layer 51 and the heater part 56, a reference gas chamber 58 is formed. Inside this reference gas chamber 58, a reference gas (for example, atmospheric gas) is introduced. The atmosphere side electrode 53 is arranged inside the reference gas chamber 58.

The solid electrolyte layer 51 is formed by a sintered body of $ZrO_2$ (zirconia), $HfO_2$, $ThO_2$, $Bi_2O_3$, or other oxygen ion conducting oxide in which CaO, MgO, $Y_2O_3$, $Yb_2O_3$, etc. is blended as a stabilizer. Further, the diffusion regulation layer 54 is formed by a porous sintered body of alumina, magnesia, silica, spinel, mullite, or another heat resistant inorganic substance. Furthermore, the exhaust side electrode 52 and atmosphere side electrode 53 are formed by platinum or other precious metal with a high catalytic activity.

Further, between the exhaust side electrode 52 and the atmosphere side electrode 53, sensor voltage Vr is applied by the voltage apply device 60 which is mounted on the ECU 31. In addition, the ECU 31 is provided with a current detection device 61 which detects the current flowing between these electrodes 52 and 53 through the solid electrolyte layer 51 when the voltage apply device 60 applies the sensor voltage Vr. The current detected by this current detection device 61 is the output current of the air-fuel ratio sensors 40 and 41.

Figure 4:
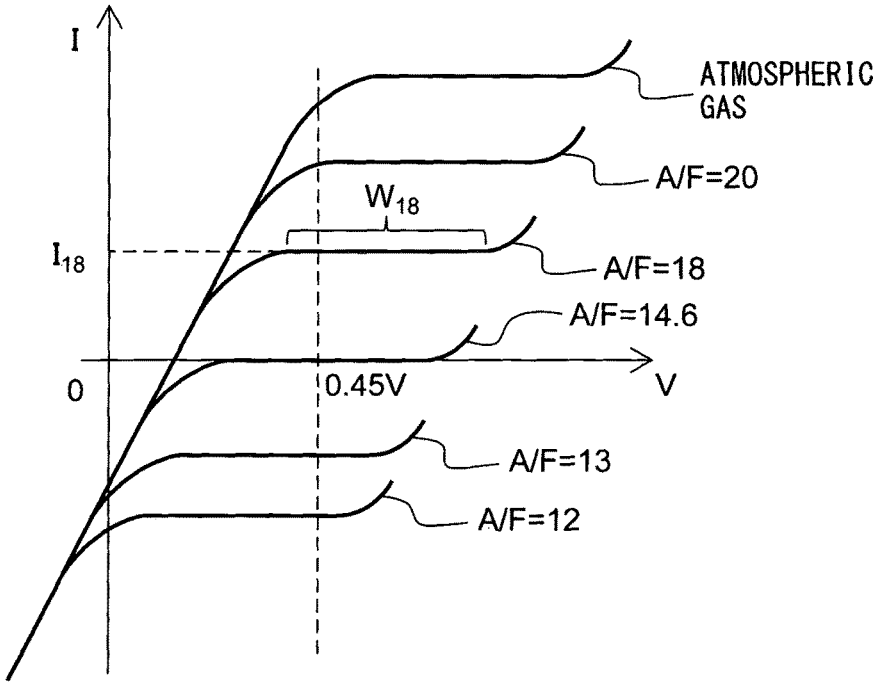
FIG. 4 is a view which shows the relationship between a voltage supplied to a sensor and output current at different exhaust air-fuel ratios.

The thus configured air-fuel ratio sensors 40 and 41 have the voltage-current (V-I) characteristic such as shown in FIG. 4. As will be understood from FIG. 4, the output current I becomes larger the higher (the leaner) the exhaust air-fuel ratio. Further, at the line V-I of each exhaust air-fuel ratio, there is a region parallel to the V axis, that is, a region where the output current does not change much at all even if the sensor voltage changes. This voltage region is called the "limit current region". The current at this time is called the "limit current". In FIG. 4, the limit current region and limit current when the exhaust air-fuel ratio is 18 are shown by $W_{18}$ and $I_{18}$.

Figure 5:
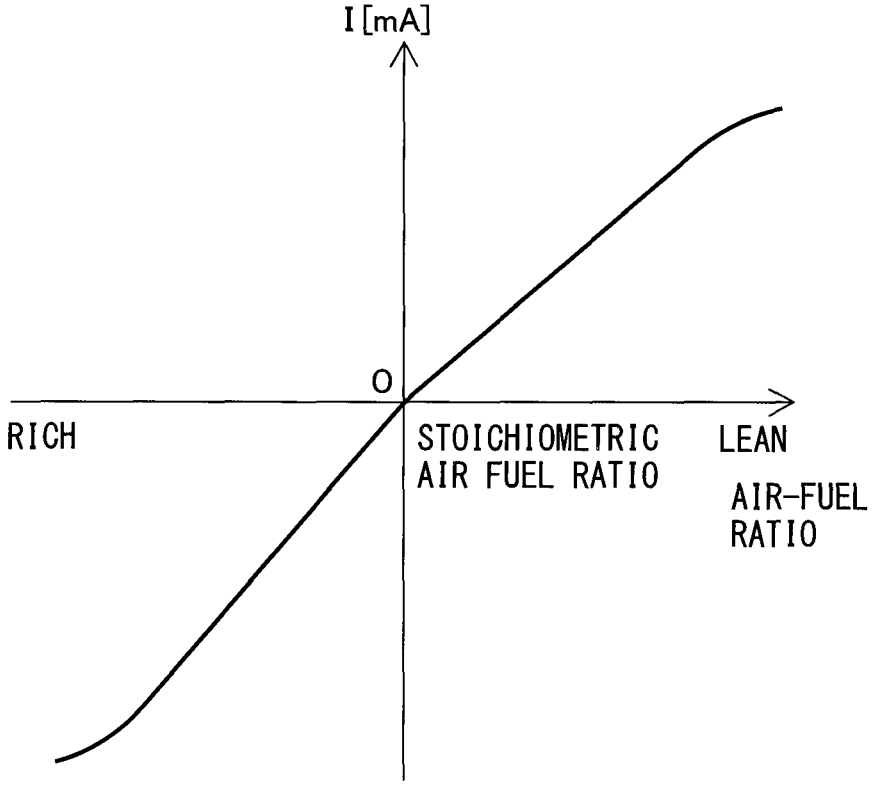
FIG. 5 is a view which shows the relationship between an exhaust air-fuel ratio and output current when making a voltage supplied to a sensor constant.

FIG. 5 is a view which shows the relationship between the exhaust air-fuel ratio and the output current I when making the supplied voltage constant at about 0.45V. As will be understood from FIG. 5, in the air-fuel ratio sensors 40 and 41, the output current is linearly changed with respect to the exhaust air fuel ratio such that the higher the exhaust air-fuel ratio (that is, the leaner), the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current, type air-fuel ratio sensors of the structure shown in FIG. 3 are used. However, as the upstream side air-fuel ratio sensor 40, for example, it is also possible to use a cup-type limit current type air-fuel ratio sensor or other structure of limit current type air-fuel ratio sensor or air-fuel ratio sensor not a limit current type or any other air-fuel ratio sensor.

<Basic Air Fuel Ratio Control>

Next, an outline of the basic air-fuel ratio control in a control device of an internal combustion engine will be explained. In the present embodiment, the fuel feed amount from the fuel injectors 11 are controlled by feedback based on the output current Irup of the upstream side air-fuel ratio sensor 40 so that the output current Irup of the upstream side air-fuel ratio sensor 40 (corresponding to air-fuel ratio of exhaust gas flowing into the exhaust purification catalyst) becomes a value corresponding to the target air-fuel ratio.

On the other hand, in the present embodiment, a target air-fuel ratio setting control for setting the target air-fuel ratio is performed based on the output current of the downstream side air-fuel ratio sensor 41 etc. In the target air-fuel ratio setting control, when the output current Irdwn of the downstream side air-fuel ratio sensor 41 becomes the rich judgment reference value Irrich or less, the target air-fuel ratio is made the lean set air-fuel ratio. After this, it is maintained at this air-fuel ratio. Here, the rich judgment reference value Irrich is a value which corresponds to a predetermined rich judgment air-fuel ratio which is slightly richer than the stoichiometric air-fuel ratio (for example, 14.55). Further, the lean set air-fuel ratio is a predetermined air-fuel ratio which is leaner by a certain extent than the stoichiometric air-fuel ratio. For example, it is made 14.65 to 20, preferably 14.68 to 18, more preferably 14.7 to 16 or so.

If the target air-fuel ratio is changed to the lean set air-fuel ratio, the oxygen excess/deficiency of the exhaust gas flowing into the upstream side exhaust purification catalyst 20 is cumulatively added. The "oxygen excess/deficiency" means the oxygen which becomes excessive or the oxygen which becomes deficient (amount of excess unburned gas etc.) when trying to make the air-fuel ratio of the exhaust gas flowing into the upstream side exhaust purification catalyst 20 the stoichiometric air-fuel ratio. In particular, when the target air-fuel ratio is the lean set air-fuel ratio, the exhaust gas flowing into the upstream side exhaust purification catalyst 20 becomes excessive in oxygen. This excess oxygen is stored in the upstream side exhaust purification catalyst 20. Therefore, the cumulative value of the oxygen excess/deficiency (below, also referred to as the "cumulative oxygen excess/deficiency") can be said to express the stored amount of oxygen OSA of the upstream side exhaust purification catalyst 20.

Note that, the oxygen excess/deficiency is calculated based on the output current Irup of the upstream side air-fuel ratio sensor 40 and the estimated value of the intake air amount to the inside of the combustion chamber 5 which is calculated based on the airflow meter 39 etc. or the fuel feed amount of the fuel injector 11 etc.

If the thus calculated oxygen excess/deficiency becomes the predetermined switching reference value (corresponding to predetermined switching reference storage amount Cref) or more, the target air-fuel ratio, which had up to that time been the lean set air-fuel ratio, is made the rich set air-fuel ratio, then is maintained at this air-fuel ratio. The rich set air-fuel ratio is a predetermined air-fuel ratio which is richer than the stoichiometric air-fuel ratio in a certain degree. For example, it is 12 to 14.58, preferably 13 to 14.57, more preferably 14 to 14.55 or so. Note that, the difference of the rich set air-fuel ratio from the stoichiometric air-fuel ratio (rich degree) is the difference of the lean set air-fuel ratio from the stoichiometric air-fuel ratio (lean degree) or less. After this, when the output current Irdwn of the downstream side air-fuel ratio sensor 41 again becomes the rich judgment reference value Irrich or less, the target air-fuel ratio is again made the lean set air-fuel ratio. After this, a similar operation is repeated.

In this way, in the present embodiment, the target air-fuel ratio of the exhaust gas flowing into the upstream side exhaust purification catalyst 20 is alternately set to the lean set air-fuel ratio and the rich set air-fuel ratio. In particular, in the present embodiment, the difference of the lean set air-fuel ratio from the stoichiometric air-fuel ratio is the difference of the rich set air-fuel ratio from the stoichiometric air-fuel ratio or more. Therefore, in the present embodiment, the target air-fuel ratio is alternately set to a short time period lean set air-fuel ratio and a long time period rich set air-fuel ratio.

<Explanation of Air Fuel Ratio Control Using Time Chart>

Figure 6:
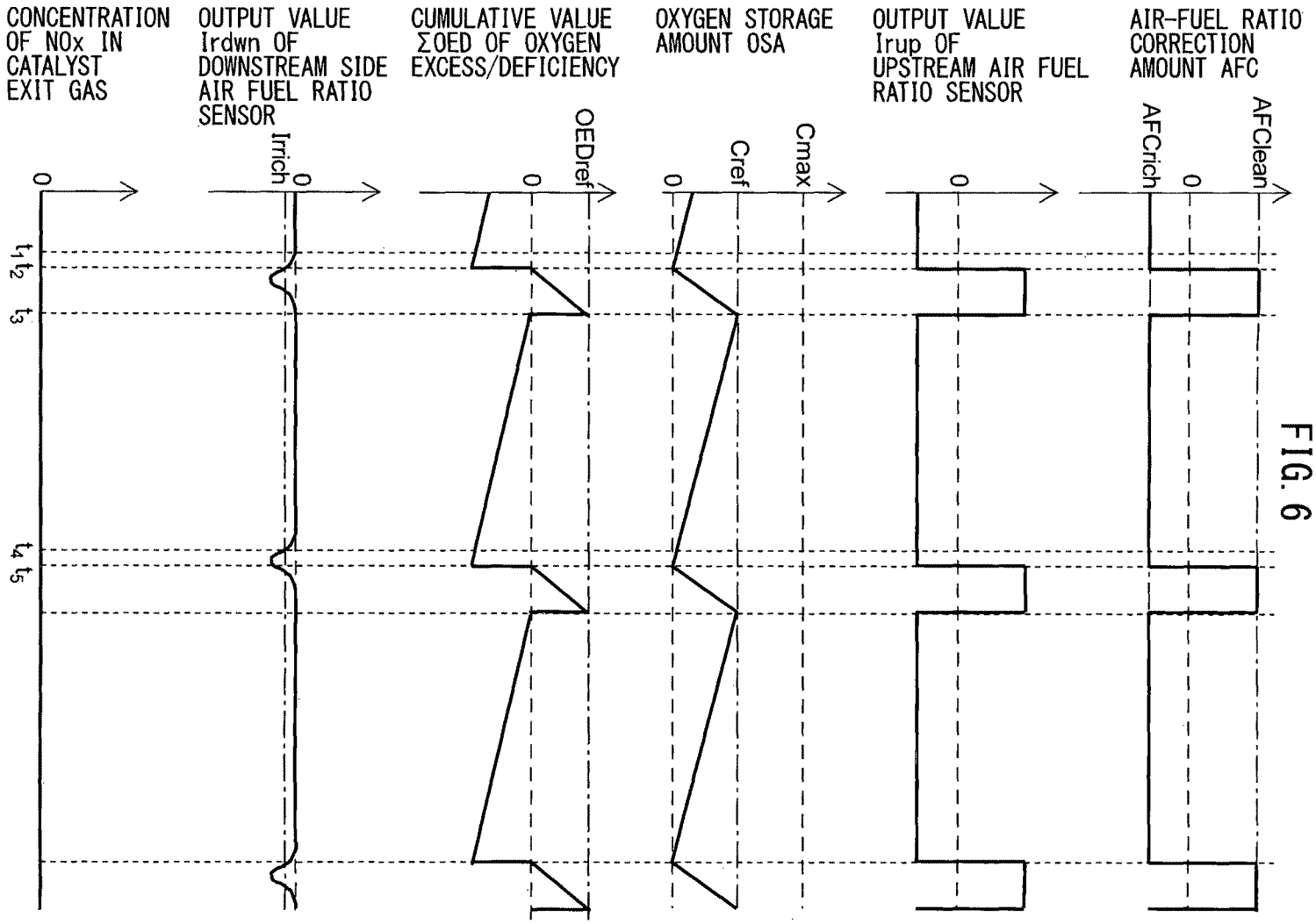
FIG. 6 is a time chart of a target air-fuel ratio etc. at the time of normal operation of an internal combustion engine.

Referring to FIG. 6, the operation explained as above will be explained in detail. FIG. 6 is a time chart of the air-fuel ratio correction amount AFC, the output current Irup of the upstream side air-fuel ratio sensor 40, the stored amount of oxygen OSA of the upstream side exhaust purification catalyst 20, the output current Irdwn of the downstream side air-fuel ratio sensor 41, the cumulative oxygen excess/deficiency ΣOED, and the concentration of $NO_x$ in the exhaust gas flowing out from the upstream side exhaust purification catalyst 20, when performing the air-fuel ratio control of the present embodiment.

Note that, the output current Irup of the upstream side air-fuel ratio sensor 40 becomes zero when the air-fuel ratio of the exhaust gas flowing into the upstream side exhaust purification catalyst 20 is the stoichiometric air-fuel ratio. In addition, the output current Irup becomes a negative value when the air-fuel ratio of the exhaust gas is a rich air-fuel ratio and becomes a positive value when the air-fuel ratio of the exhaust gas is the lean air-fuel ratio. Further, when the air-fuel ratio of the exhaust gas flowing into the upstream side exhaust purification catalyst 20 is the rich air-fuel ratio or lean air-fuel ratio, the larger the difference from the stoichiometric air-fuel ratio, the larger the absolute value of the output current Irup of the upstream side air-fuel ratio sensor 40.

The output current Irdwn of the downstream side air-fuel ratio sensor 41 also changes in accordance with the air-fuel ratio of the exhaust gas flowing out from the upstream side exhaust purification catalyst 20 in the same way as the output current Irup of the upstream side air-fuel ratio sensor 40. Further, the air-fuel ratio correction amount AFC is a correction amount relating to the target air-fuel ratio of the exhaust gas flowing into the upstream side exhaust purification catalyst 20, and shows a correction amount with respect to an air-fuel ratio of center of control (in this embodiment, stoichiometric air-fuel ratio). When the air-fuel ratio correction amount AFC is 0, the target air-fuel ratio is the stoichiometric air-fuel ratio. When the air-fuel ratio correction amount AFC is a positive value, the target air-fuel ratio becomes a lean air-fuel ratio. When the air-fuel ratio correction amount AFC is a negative value, the target air-fuel ratio becomes a rich air-fuel ratio.

In the illustrated example, in the state before the time $t_1$, the air-fuel ratio correction amount AFC is the rich set correction amount AFCrich (corresponding to the rich set air-fuel ratio). That is, the target air-fuel ratio is the rich air-fuel ratio. Along with this, the output current Irup of the upstream side air-fuel ratio sensor 40 becomes a negative value. Unburned gas contained in the exhaust gas flowing into the upstream side exhaust purification catalyst 20 is purified by the upstream side exhaust purification catalyst 20, and along with this the upstream side exhaust purification catalyst 20 is gradually decreased in the stored amount of oxygen OSA. Therefore, the cumulative oxygen excess/deficiency ΣOED is also gradually decreased. The unburned gas is not contained in the exhaust gas flowing out from the upstream side exhaust purification catalyst 20 by the purification at the upstream side exhaust purification catalyst 20, and therefore the output current Irdwn of the downstream side air-fuel ratio sensor 41 becomes substantially 0 (corresponding to stoichiometric air-fuel ratio). Note that, since the air-fuel ratio of the exhaust gas flowing into the upstream side exhaust purification catalyst 20 becomes the rich air-fuel ratio, the amount of $NO_x$ exhausted from the upstream side exhaust purification catalyst 20 becomes substantially zero.

If the upstream side exhaust purification catalyst 20 gradually decreases in stored amount of oxygen OSA, the stored amount of oxygen OSA approaches zero at the time $t_1$. Along with this, part of the unburned gas flowing into the upstream side exhaust purification catalyst 20 starts to flow out without being purified by the upstream side exhaust purification catalyst 20. Due to this, from the time $t_1$ on, the output current Irdwn of the downstream side air-fuel ratio sensor 41 gradually falls. As a result, at the time $t_2$, the output current Irdwn of the downstream side air-fuel ratio sensor 41 reaches the rich judgment reference value Irrich which corresponds to the rich judgment air-fuel ratio.

In the present embodiment, when the output current Irdwn of the downstream side air-fuel ratio sensor 41 becomes the rich judgment reference value Irrich or less, to increase the stored amount of oxygen OSA, the air-fuel ratio correction amount AFC is switched to the lean set correction amount AFClean (corresponding to the lean set air-fuel ratio). Therefore, the target air-fuel ratio is switched from the rich air-fuel ratio to the lean air-fuel ratio. Further, at this time, the cumulative oxygen excess/deficiency ΣOED is reset to 0.

Note that, in the present embodiment, the air-fuel ratio correction amount AFC is switched after the output current Irdwn of the downstream side air-fuel ratio sensor 41 reaches the rich judgment reference value Irrich, that is, after the air-fuel ratio of the exhaust gas flowing out from the upstream side exhaust purification catalyst 20 reaches the rich judgment air-fuel ratio. This is because even if the stored amount of oxygen of the upstream side exhaust purification catalyst 20 is sufficient, the air-fuel ratio of the exhaust gas flowing out from the upstream side exhaust purification catalyst 20 is slightly offset from the stoichiometric air-fuel ratio. Conversely speaking, the rich judgment air-fuel ratio is set such that the air-fuel ratio of the exhaust gas flowing out from the upstream side exhaust purification catalyst 20 will never reach when the stored amount of oxygen of the upstream side exhaust purification catalyst 20 is sufficient.

When the target air-fuel ratio is switched to the lean air-fuel ratio at the time $t_2$, the air-fuel ratio of the exhaust gas flowing into the upstream side exhaust purification catalyst 20 changes from the rich air-fuel ratio to the lean air-fuel ratio. Further, along with this, the output current Irup of the upstream side air-fuel ratio sensor 40 becomes a positive value (in actuality, a delay occurs from when the target air-fuel ratio is switched to when the air-fuel ratio of the exhaust gas flowing into the upstream side exhaust purification catalyst 20 changes, but in the illustrated example, it is deemed for convenience that the change is simultaneous). If at the time $t_2$ the air-fuel ratio of the exhaust gas flowing into the upstream side exhaust purification catalyst 20 changes to the lean air-fuel ratio, the upstream side exhaust purification catalyst 20 increases in the stored amount of oxygen OSA. Further, along with this, the cumulative oxygen excess/deficiency ΣOED also gradually increases.

Due to this, the air-fuel ratio of the exhaust gas flowing out from the upstream side exhaust purification catalyst 20 changes to the stoichiometric air-fuel ratio, and the output current Irdwn of the downstream side air-fuel ratio sensor 41 converges to 0. At this time, the air-fuel ratio of the exhaust gas flowing into the upstream side exhaust purification catalyst 20 becomes the lean air-fuel ratio, but there is sufficient leeway in the oxygen storage ability of the upstream side exhaust purification catalyst 20, and therefore the oxygen in the inflowing exhaust gas is stored in the upstream side exhaust purification catalyst 20 and the $NO_x$ is reduced and purified.

After this, if the upstream side exhaust purification catalyst 20 increases in stored amount of oxygen OSA, at the time $t_3$, the stored amount of oxygen OSA of the upstream side exhaust purification catalyst 20 reaches the switching reference storage amount Cref. For this reason, the cumulative oxygen excess/deficiency ΣOED reaches the switching reference value OEDref which corresponds to the switching reference storage amount Cref. In the present embodiment, if the cumulative oxygen excess/deficiency ΣOED becomes the switching reference value OEDref or more, the storage of oxygen in the upstream side exhaust purification catalyst 20 is suspended by switching the air-fuel ratio correction amount AFC to the rich set correction amount AFCrich. Therefore, the target air-fuel ratio becomes the rich air-fuel ratio. Further, at this time, the cumulative oxygen excess/deficiency ΣOED is reset to 0. Note that, the switching reference storage amount Cref is ¾ or less of the maximum storable oxygen amount Cmax when the upstream side exhaust purification catalyst 20 is new, preferably ½ or less, more preferably ⅕ or less.

If the target air-fuel ratio is switched to the rich air-fuel ratio at the time $t_3$, the air-fuel ratio of the exhaust gas flowing into the upstream side exhaust purification catalyst 20 changes from the lean air-fuel ratio to the rich air-fuel ratio. Along with this, the output current Irup of the upstream side air-fuel ratio sensor 40 becomes a negative value (in actuality, a delay occurs from when the target air-fuel ratio is switched to when the exhaust gas flowing into the upstream side exhaust purification catalyst 20 changes in air-fuel ratio, but in the illustrated example, it is deemed for convenience that the change is simultaneous). The exhaust gas flowing into the upstream side exhaust purification catalyst 20 contains unburned gas, and therefore the upstream side exhaust purification catalyst 20 gradually decreases in stored amount of oxygen OSA. At the time $t_4$, in the same way as the time $t_1$, the output current Irdwn of the downstream side air-fuel ratio sensor 41 starts to fall. At this time as well, the air-fuel ratio of the exhaust gas flowing into the upstream side exhaust purification catalyst 20 is the rich air-fuel ratio, and therefore $NO_x$ exhausted from the upstream side exhaust purification catalyst 20 is substantially zero.

Next, at the time $t_5$, in the same way as time $t_2$, the output current Irdwn of the downstream side air-fuel ratio sensor 41 reaches the rich judgment reference value Irrich which corresponds to the rich judgment air-fuel ratio. Due to this, the air-fuel ratio correction amount AFC is switched to the value AFClean which corresponds to the lean set air-fuel ratio. After this, the cycle of the above mentioned times $t_1$ to $t_5$ is repeated.

As will be understood from the above explanation, according to the present embodiment, it is possible to constantly suppress the amount of $NO_x$ exhausted from the upstream side exhaust purification catalyst 20. Further, since the cumulative period for calculating the cumulative oxygen excess/deficiency ΣOED is short, comparing with the case where the cumulative period is long, a possibility of error occurring is low. Therefore, it is suppressed that NOx is exhausted from the upstream side exhaust purification catalyst 20 due to the calculation error in the cumulative oxygen excess/deficiency ΣOED. Further, in general, if the stored amount of oxygen of the exhaust purification catalyst is maintained constant, the exhaust purification catalyst falls in oxygen storage ability. As opposed to this, according to the present embodiment, as shown in FIG. 6, the stored amount of oxygen OSA of the upstream side exhaust purification catalyst 20 constantly fluctuates up and down, and therefore the oxygen storage ability is kept from falling.

Note that, in the present embodiment, setting of the air-fuel ratio correction amount AFC, that is, setting of the target air-fuel ratio, is performed by the ECU 31. Therefore, it can be said that when the air-fuel ratio of the exhaust gas detected by the downstream side air-fuel ratio sensor 41 becomes the rich judgment air-fuel ratio or less, the ECU 31 makes the target air-fuel ratio of the exhaust gas flowing into the upstream side exhaust purification catalyst 20 the lean air-fuel ratio continuously or intermittently until the stored amount of oxygen OSA of the upstream side exhaust purification catalyst 20 becomes the switching reference storage amount Cref, and when the stored amount of oxygen OSA of the upstream side exhaust purification catalyst 20 becomes the switching reference storage amount Cref or more the ECU 31 makes the target air-fuel ratio the rich air-fuel ratio continuously or intermittently until the air-fuel ratio of the exhaust gas detected by the downstream side air-fuel ratio sensor 41 becomes the rich judgment air-fuel ratio or less without the stored amount of oxygen OSA reaching the maximum storable oxygen amount Cmaxn.

More simply speaking, in the present embodiment, it can be said that the ECU 31 switches the target air-fuel ratio to the lean air-fuel ratio when the air-fuel ratio detected by the downstream side air-fuel ratio sensor 41 becomes the rich judgment air-fuel ratio or less and switches the target air-fuel ratio to the rich air-fuel ratio when the stored amount of oxygen OSA of the upstream side exhaust purification catalyst 20 becomes the switching reference storage amount Cref or more.

<Basic Diagnosis of Air-Fuel Ratio Sensors for Abnormality>

In the meantime, the air-fuel ratio sensors 40 and 41 sometimes suffer from error in their output currents due to manufacturing error and deterioration over time etc. Therefore, even if the air-fuel ratio of the flowing exhaust gas is the same, sometimes the output currents become different values. If the error becomes larger, that is, if the difference between the actual air-fuel ratio of the exhaust gas and the air-fuel ratios corresponding to the output currents of the air-fuel ratio sensors 40 and 41 becomes greater, the above-mentioned air-fuel ratio control can no longer be suitably performed. Therefore, in an embodiment of the present invention, the air-fuel ratio sensors 40 and 41 are diagnosed to determine if large error has occurred in their output currents, that is, are diagnosed for abnormality.

Specifically, first, during operation of the internal combustion engine, the feed of fuel to the inside of the combustion chambers 5 is stopped, that is, fuel cut control is performed. This fuel cut control is, for example, performed at the time of deceleration of the vehicle which mounts the internal combustion engine etc. During fuel cut control, fuel is not fed, and therefore atmospheric gas flows out from the combustion chambers 5. As a result, atmospheric gas is introduced into the upstream side exhaust purification catalyst 20 and atmospheric gas flows around the both air-fuel ratio sensors 40 and 41.

In this way, during fuel cut control, atmospheric gas flows around the both air-fuel ratio sensors 40 and 41, and therefore as long as no error occurs in the output currents of the air-fuel ratio sensors 40 and 41, the output currents of the air-fuel ratio sensors 40 and 41 during fuel cut control basically always become similar values (below, these values will be called "normal output values"). Therefore, in the present embodiment, during fuel cut control, when the output currents of the air-fuel ratio sensors 40 and 41 are in predetermined ranges of normal judgment centered about their normal output values, it is judged that the air-fuel ratio sensors 40 and 41 do not include large error in their output currents, that is, they are normal. On the other hand, during fuel cut control, when the output currents of the air-fuel ratio sensors 40 and 41 are outside the predetermined ranges of normal judgment, it is judged that the air-fuel ratio sensors 40 and 41 include large error in their output currents, that is, the air-fuel ratio sensors 40 and 41 have become abnormal.

Figure 7:
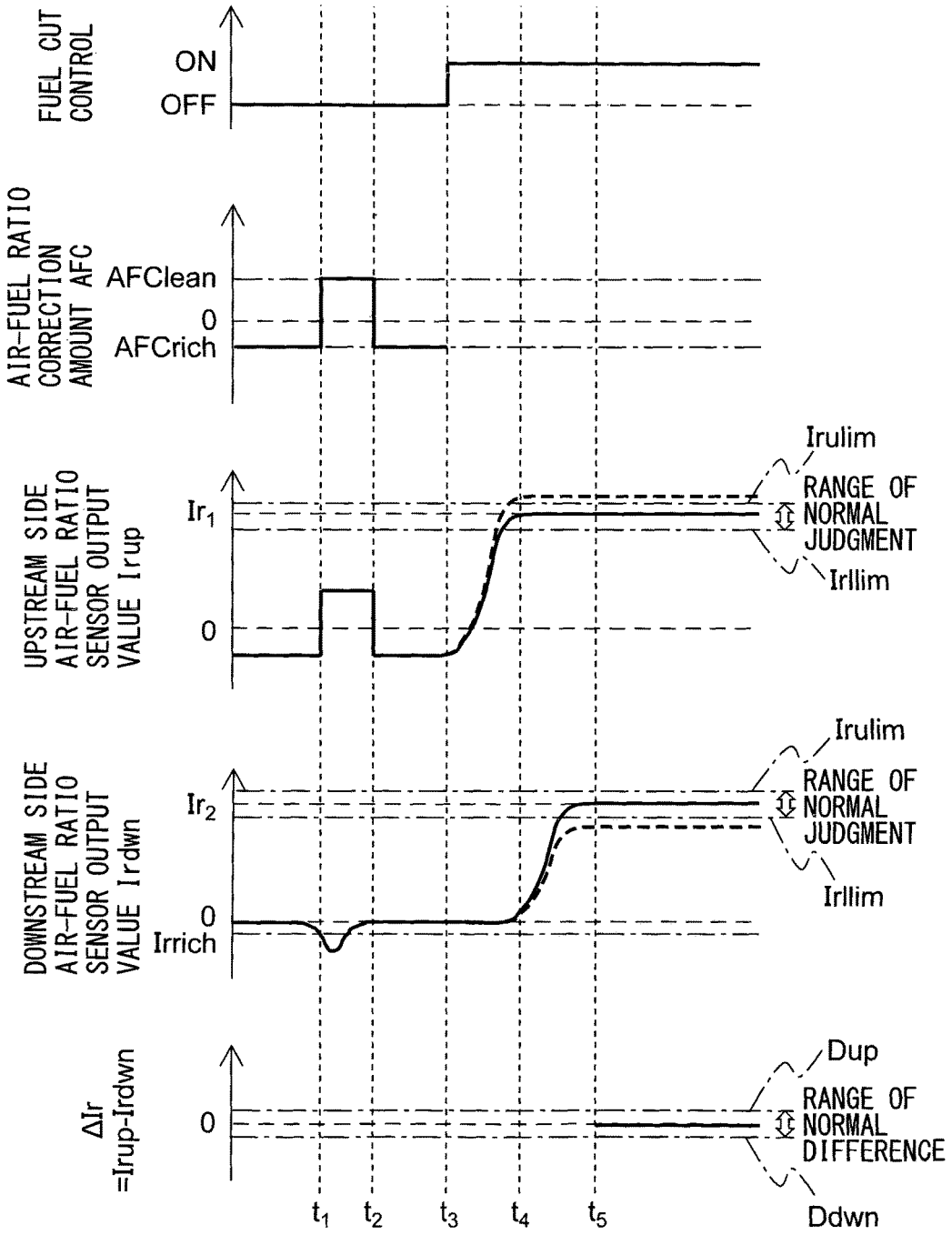
FIG. 7 is a time chart of an output current of an air-fuel sensor at the time of fuel cut control etc.

FIG. 7 is a time chart of the output currents etc. of the both air-fuel ratio sensors 40 and 41 at the time of fuel cut control. In the example which is shown in FIG. 7, at the time $t_3$, fuel cut control is stared. Before the time $t_3$, the air-fuel ratio control shown in FIG. 6 is performed. At the time $t_3$, if fuel cut control is started, the feed of fuel from the fuel injectors 11 is stopped. Therefore, the above-mentioned air-fuel ratio control, that is, the feedback control based on the output current Irup of the upstream side air-fuel ratio sensor 40, is stopped. For this reason, the operation of setting the target air-fuel ratio, that is, the operation of setting the air-fuel ratio correction amount, is also stopped.

If, at the time $t_3$, the fuel cut control is started, atmospheric gas is exhausted from the combustion chambers 5 and atmospheric gas flows around the upstream side air-fuel ratio sensor 40. For this reason, along with the start of fuel cut control, the output current Irup of the upstream side air-fuel ratio sensor 40 rapidly rises. When the output current Irup of the upstream side air-fuel ratio sensor 40 does not include error, after that, the output current Irup, as shown in FIG. 7 by the solid line, converges to an extremely large positive value (normal output value) $Ir_1$ from the time $t_4$ on.

On the other hand, the output current Irdwn of the downstream side air-fuel ratio sensor 41 does not immediately rise even if fuel cut control is started at the time $t_3$. This is because just after the start of fuel cut control, the upstream side exhaust purification catalyst 20 arranged at the upstream side from the downstream side air-fuel ratio sensor 41 in the exhaust flow direction stores oxygen from the exhaust gas. For this reason, the amount of oxygen in the exhaust gas discharged from the upstream side exhaust purification catalyst 20 is decreased and, as a result, the output current of the downstream side air-fuel ratio sensor 41 does not immediately rise.

However, during fuel cut control, the flow rate of oxygen flowing into the upstream side exhaust purification catalyst 20 is extremely large, and therefore the stored amount of oxygen of the upstream side exhaust purification catalyst 20 reaches the maximum storable oxygen amount Cmax immediately after the start of fuel cut control. For this reason, the output current Irdwn of the downstream side air-fuel ratio sensor 41 rapidly rises slightly delayed from the rise of the output current of the upstream side air-fuel ratio sensor 40. When there is no error in the output current Irdwn of the downstream side air-fuel ratio sensor 41, after that, the output current Irdwn, as shown in FIG. 7 by the solid line, converges to an extremely large positive value (normal output value) $Ir_2$ from the time $t_5$ on.

As explained above, in fuel cut control, the output currents of the air-fuel ratio sensors 40 and 41 converges to constant values (normal output values) so long as no error occurs. Therefore, when the output current Irup of the upstream side air-fuel ratio sensor 40 and the output current Irdwn of the downstream side air-fuel ratio sensor 41 converge to, as shown in FIG. 7 by the solid lines, the range of normal judgment (normal upper limit value Irulim or less and normal lower limit value Irllim or more), basically it is judged that these air-fuel ratio sensors 41 are normal.

On the other hand, when there is large error in the output currents of the air-fuel ratio sensors 40 and 41, the output currents converge to values different from the normal output values. Such a case is shown in FIG. 7 by the broken lines. In the example shown in FIG. 7 by the broken line, during fuel cut control, the output current Irup of the upstream side air-fuel ratio sensor 40 becomes a value larger than the normal output value which inherently should be output, due to error. As a result, during fuel cut control, the output current Irup of the upstream side air-fuel ratio sensor 40 converges to a value outside the range of normal judgment, specifically, to a value larger than the normal upper limit value Irulim. In this case, it is judged that the upstream side air-fuel ratio sensor 40 has become abnormal.

Further, in the example which is shown in FIG. 7 by the broken line, during fuel cut control, the output current Irdwn of the downstream side air-fuel ratio sensor 41 becomes a value smaller than the normal output value which inherently should be output, due to error. As a result, during fuel cut control, the output current Irdwn of the downstream side air-fuel ratio sensor 41 converges to a value outside the range of normal judgment, specifically, a value smaller than the normal lower limit value Irllim. In the present embodiment, in this case, it is judged that the downstream side air-fuel ratio sensor 41 has become abnormal.

In this way, in the present embodiment, during fuel cut control, diagnosis of abnormality is performed based on the output currents of the air-fuel ratio sensors 40 and 41. Therefore, diagnosis of abnormality is performed when the exhaust gas flowing around the air-fuel ratio sensors 40 and 41 is atmospheric gas, that is, when the air-fuel ratio of the exhaust gas is known. For this reason, the air-fuel ratio sensors 40 and 41 can be accurately diagnosed for abnormality.

<Flow Chart of Basic Diagnosis of Abnormality>

Figure 8:
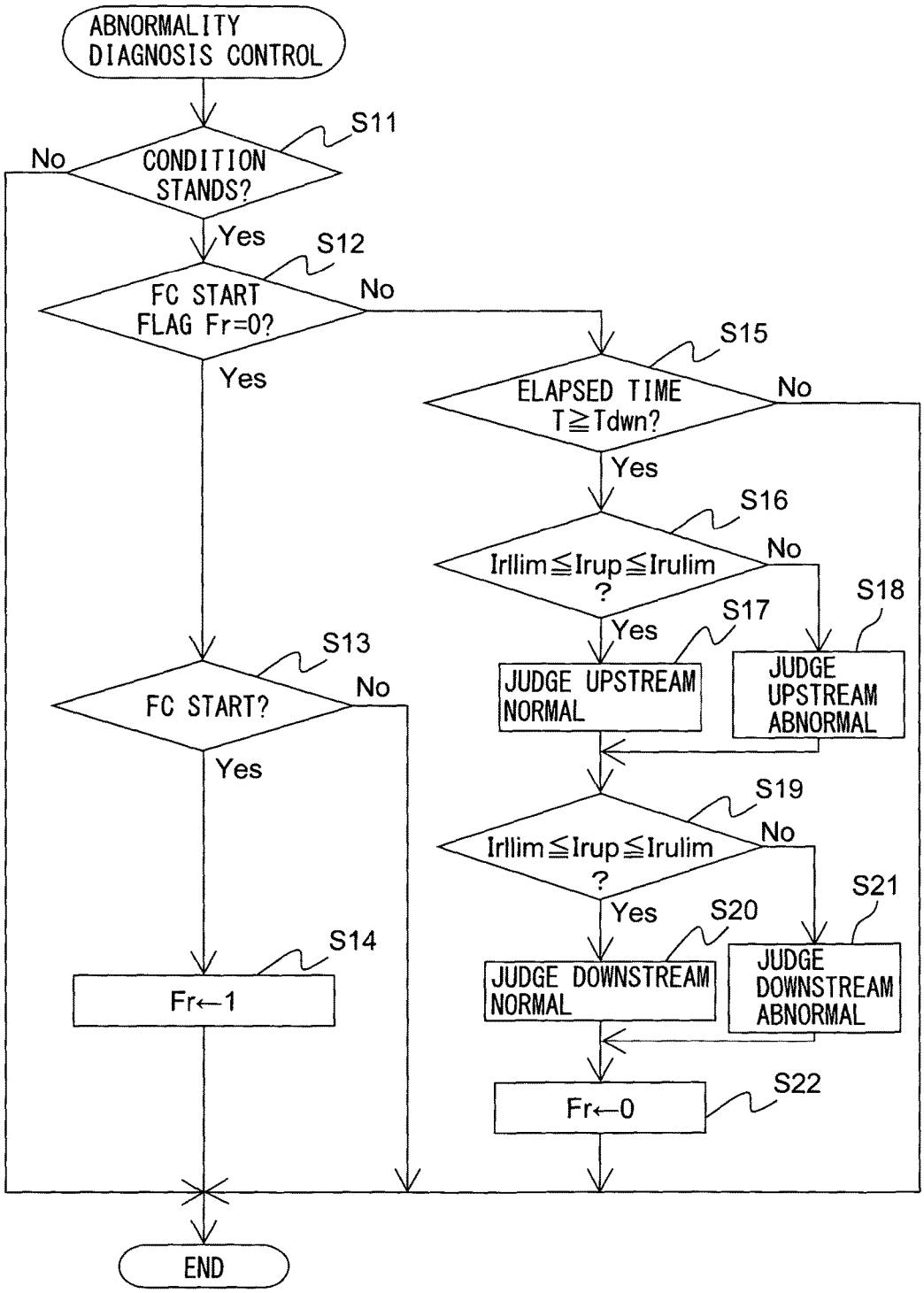
FIG. 8 is a flow chart which shows a control routine of abnormality diagnosis control of an air-fuel ratio sensor.

FIG. 8 is a flow chart showing a control routine for abnormality diagnosis control of the above-mentioned air-fuel ratio sensors 40 and 41. The illustrated control routine is performed by interruption at predetermined time intervals.

First, at step S11, it is judged if the condition for diagnosis of abnormality of the air-fuel ratio sensors 40 and 41 stands. The condition for abnormality diagnosis control stands, for example, when a conditions such as the temperatures of the both air-fuel ratio sensors 40 and 41 being in predetermined temperature ranges and abnormality diagnosis control not yet being performed after the ignition switch of the vehicle which mounts the internal combustion engine was turned on are satisfied. When, at step S11, it is judged that the condition for abnormality diagnosis control is not satisfied, the control routine is ended. On the other hand, when it is judged that the condition stands, the routine proceeds to step S12.

At step S12, it is judged if the FC start flag Fr is "0". The FC start flag Fr is a flag which is set to "1" when fuel cut control is started and is reset to "0" when diagnosis of abnormality has ended. When it is judged that the FC start flag Fr is "0", the routine proceeds to step S13. At step S13, it is judged if the fuel cut control has been started. When the fuel cut control has not been started, the control routine is ended. On the other hand, when it is judged at step S13 that the fuel cut control has started, the routine proceeds to step S14. At step S14, the FC start flag Fr is set to "1" and the control routine is ended.

At the next control routine, since the FC start flag Fr is set to "1", the routine proceeds from step S12 to step S15. At step S15, it is judged if the elapsed time T from when the fuel cut control was started is a predetermined reference time Tdwn or more. Note that, this reference time Tdwn is a time more than the time which is normally taken after the start of fuel cut control until the output current of the downstream side air-fuel ratio sensor 41 converges. When it is judged that the elapsed time T is less than the reference time Tdwn, the control routine is ended.

After that, when the elapsed time T becomes the reference time Tdwn or more, in the control routine after that, the routine proceeds from step S15 to step S16. At step S16, it is judged if the output current Irup of the upstream side air-fuel ratio sensor 40 is within the range of normal judgment (Irllim or more and Irulim or less). When it is judged to be in the range of normal judgment, the routine proceeds to step S17. At step S17, it is judged that the upstream side air-fuel ratio sensor 40 is normal. On the other hand, when it is judged at step S16 that the output current Irup is outside the range of normal judgment, the routine proceeds to step S18. At step S18, it is judged that the upstream side air-fuel ratio sensor 40 has become abnormal.

After that, at step S19, it is judged if the output current Irdwn of the downstream side air-fuel ratio sensor 41 is within the range of normal judgment. When it is judged to be in the range of normal judgment, the routine proceeds to step S20 where it is judged that the downstream side air-fuel ratio sensor 41 is normal. On the other hand, when it is judged at step S19 that the output current Irdwn is outside the range of normal judgment, the routine proceeds to step S21. At step S21, it is judged that the downstream side air-fuel ratio sensor 41 has become abnormal. After that, at step S22, the FC start flag Fr is reset to "0" and the control routine is ended.

<Problem 1 in Diagnosis of Abnormality>

In the meantime, when diagnosing the air-fuel ratio sensors 40 and 41 for abnormality in the above way, there are generally speaking two problems. Below, these will be explained.

First, the first problem will be explained. Error occurs in the output currents of the air-fuel ratio sensors 40 and 41, as explained above, due to manufacturing error, deterioration over time, etc. The main reason why error occurs in this way is believed to be the state of the diffusion regulation layers 54. For example, when manufacturing the air-fuel ratio sensors 40 and 41, if the thickness of the diffusion regulation layers 54 becomes greater than the design value due to manufacturing error, the output current will tend to become smaller. On the other hand, when manufacturing the air-fuel ratio sensors 40 and 41, if the thickness of the diffusion regulation layers 54 becomes smaller than the design value due to manufacturing error, the output current will tend to become larger.

Further, during operation of the internal combustion engine, the diffusion regulation layers 54 are exposed to the exhaust gas, and therefore sometimes particles in the exhaust gas clog the pores of the porous diffusion regulation layers 54. If the diffusion regulation layers 54 are clogged by a large amount of particles, it becomes harder for the exhaust gas to flow into the measured gas chambers 57, and as a result the output currents of the air-fuel ratio sensors 40 and 41 become smaller.

However, the output currents of the air-fuel ratio sensors 40 and 41 fluctuate not only due to manufacturing error, deterioration over time, etc., but also due to atmospheric pressure. That is, in general, the higher the pressure of the exhaust gas flowing around the air-fuel ratio sensors 40 and 41, the larger the output currents of the air-fuel ratio sensors 40 and 41. Further, in fuel cut control, the pressure of the exhaust gas flowing around the air-fuel ratio sensors 40 and 41 is proportional to the atmospheric pressure. Therefore, for example, when the vehicle mounting the internal combustion engine is being driven at a high altitude location etc. and the atmospheric pressure becomes lower, the output currents of the air-fuel ratio sensors 40 and 41 fall along with this. For this reason, when the atmospheric pressure is low, even if the air-fuel ratio sensors 40 and 41 have actually not become abnormal, during fuel cut control, the output currents of these air-fuel ratio sensors 40 and 41 become values different from the normal output values.

Figure 9:
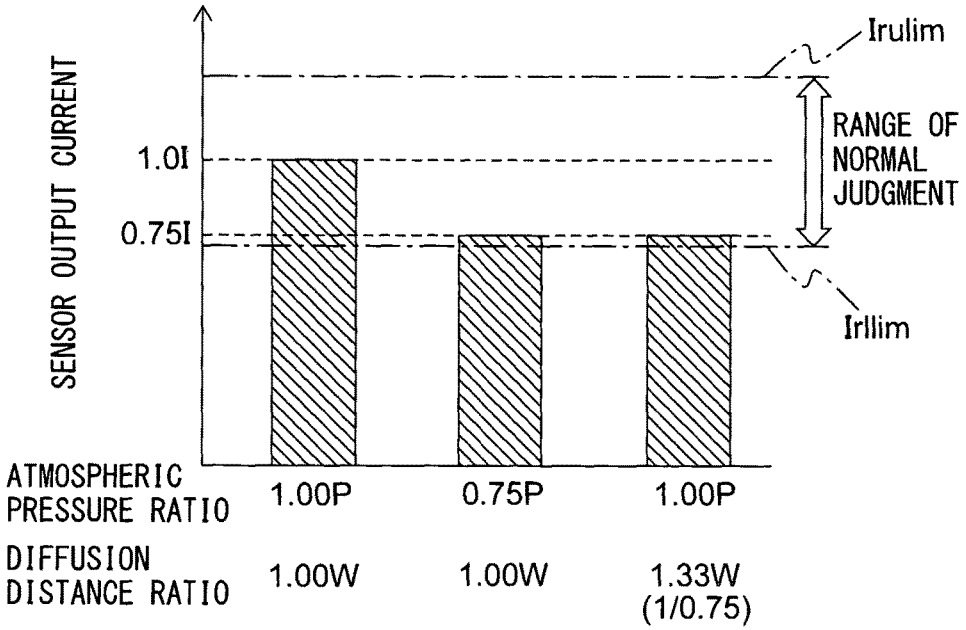
FIG. 9 is a view which shows a relationship between an atmospheric pressure and a diffusion distance at a diffusion regulation layer and the output current of an air-fuel ratio sensor.

FIG. 9 is a view showing the relationship between the atmospheric pressure and diffusion distance in the diffusion regulation layers, and the output currents of the air-fuel ratio sensors. In the example shown in FIG. 9, when the atmospheric pressure is P (for example, 1 atm) and the diffusion distance is W (for example, the design value), the output currents of the air-fuel ratio sensors are deemed to be I (normal output value). Note that, the diffusion distance W means the ease of passing through the diffusion regulation layers 54. For example, when the particles clog the layers or when the thicknesses of the diffusion regulation layers 54 become greater, the diffusion distance W becomes larger.

Here, when the atmospheric pressure is 0.75 time of P, for the same air-fuel ratio, the output currents of the air-fuel ratio sensors become 0.75 time of I. Here, in general, a vehicle mounting the internal combustion engine could conceivably be driven at an altitude of about 0.75 atmosphere. Therefore, despite the fact that no error occurs in the air-fuel ratio sensors 40 and 41 even in actual use, the output currents could become values of 0.75 time of the suitable value. For this reason, to prevent mistaken judgment that error has occurred in the air-fuel ratio sensors 40 and 41 in such a case, as shown in FIG. 9, it is necessary to broaden the range of normal judgment to a certain extent.

On the other hand, even when the diffusion distance is 1.33 times of W, for the same air-fuel ratio, the output currents of the air-fuel ratio sensors become 0.75 time of I. That is, as explained above, if broadening the range of normal judgment to a certain extent, even if actually the diffusion distance changes and thus error occurs in the air-fuel ratio sensors 40 and 41, sometimes it will not be possible to judge that the air-fuel ratio sensors 40 and 41 have become abnormal.

<Problem 2 in Diagnosis of Abnormality>

Next, the second problem will be explained.

In the meantime, the exhaust purification catalysts 20 and 24 deteriorate the longer they are used. It is known that if the exhaust purification catalysts 20 and 24 deteriorate in this way, along with this, the maximum storable oxygen amounts Cmax decrease. For this reason, in most internal combustion engines provided with exhaust purification catalysts 20 and 24, the maximum storable oxygen amounts Cmax is calculated to diagnose the degrees of deterioration of the exhaust purification catalysts 20 and 24. The maximum storable oxygen amounts Cmax are, for example, calculated by active air-fuel ratio control where the target air-fuel ratio is alternately switched between the rich air-fuel ratio and the lean air-fuel ratio.

Figure 10:
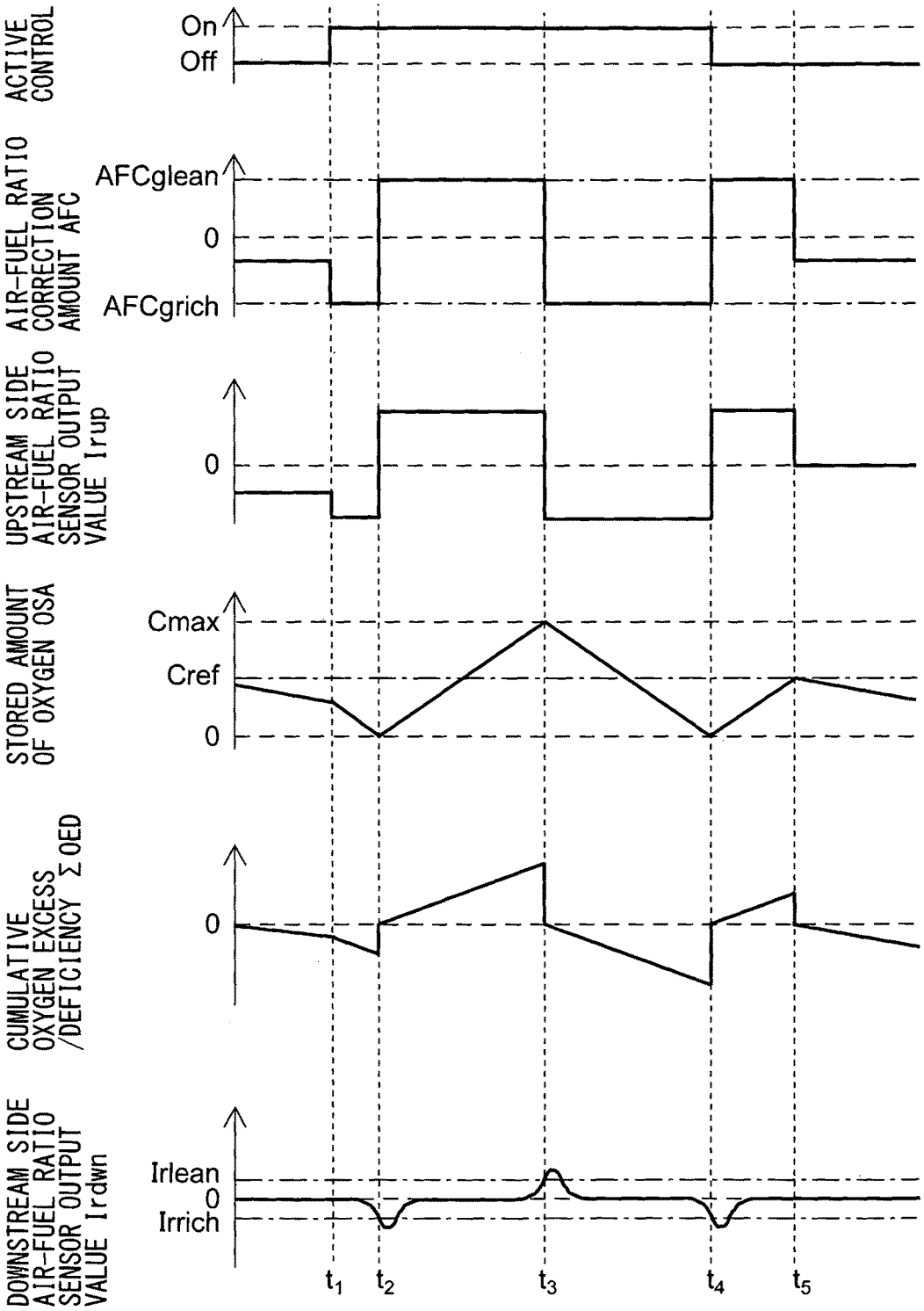
FIG. 10 is a time chart of the air-fuel ratio correction amount etc. when performing active air-fuel ratio control.

FIG. 10 is a time chart of the air-fuel ratio correction amount etc. when performing active air-fuel ratio control when diagnosing the upstream side exhaust purification catalyst 20 for abnormality. In the example shown in FIG. 10, before the time $t_1$, the air-fuel ratio control shown in FIG. 6 is performed.

If the active air-fuel ratio control is started at the time $t_1$, in the example shown in FIG. 10, the air-fuel ratio correction amount AFC becomes an active rich set correction amount AFCgrich which is smaller than the rich set correction amount AFCrich. Along with this, the output current of the upstream side air-fuel ratio sensor 40 becomes smaller and the speed of decrease of the stored amount of oxygen OSA increases. After that, if the stored amount of oxygen OSA becomes substantially zero, unburned gas starts to flow out from the upstream side exhaust purification catalyst 20. As a result, at the time $t_2$, the output current Irdwn of the downstream side air-fuel ratio sensor 41 reaches the rich judgment reference value Irrich. At the time $t_2$, the air-fuel ratio correction amount AFC is switched to an active lean set correction amount AFCglean which is larger than the lean set correction amount AFClean. Further, at the time $t_2$, the cumulative oxygen excess/deficiency ΣOED is reset to zero.

If the air-fuel ratio correction amount AFC is switched at the time $t_2$, the output current Irup of the upstream side air-fuel ratio sensor 40 changes to a value larger than zero. Further, the stored amount of oxygen OSA of the upstream side exhaust purification catalyst 20 gradually increases. Further, along with this, the cumulative oxygen excess/deficiency ΣOED gradually increases. On the other hand, the oxygen in the exhaust gas flowing into the upstream side exhaust purification catalyst 20 is stored in the upstream side exhaust purification catalyst 20, and therefore the output current of the downstream side air-fuel ratio sensor 41 converges to zero.

After that, the stored amount of oxygen OSA of the upstream side exhaust purification catalyst 20 increases. When the stored amount of oxygen OSA becomes substantially the maximum storable oxygen amount Cmax, oxygen starts to flow out from the upstream side exhaust purification catalyst 20. As a result, at the time $t_3$, the output current Irdwn of the downstream side air-fuel ratio sensor 41 reaches the lean judgment reference value Irlean. Note that, the lean judgment reference value Irlean is a value corresponding to a predetermined lean judgment air-fuel ratio (for example, 14.65) which is slightly leaner than the stoichiometric air-fuel ratio. At the time $t_3$, the air-fuel ratio correction amount AFC is again switched to the active rich set correction amount AFCgrich. Further, at this time as well, the cumulative oxygen excess/deficiency ΣOED is reset to zero.

At the time $t_3$, if the air-fuel ratio correction amount AFC is switched, after that, the stored amount of oxygen OSA of the upstream side exhaust purification catalyst 20 follows the same trend as at the times $t_1$ to $t_2$. At the time $t_4$, the output current Irdwn of the downstream side air-fuel ratio sensor 41 again reaches the rich judgment reference value Irrich. Due to this, the active air-fuel ratio control is ended and normal operation is resumed.

Here, the cumulative oxygen excess/deficiency ΣOED at the time $t_3$ and the cumulative oxygen excess/deficiency ΣOED at the time $t_4$ (more precisely, their absolute values) represent the maximum storable oxygen amount Cmax. Therefore, for example; it is possible to calculate the maximum storable oxygen amount Cmax from the average value of these cumulative oxygen excess/deficiencies.

Figure 11:
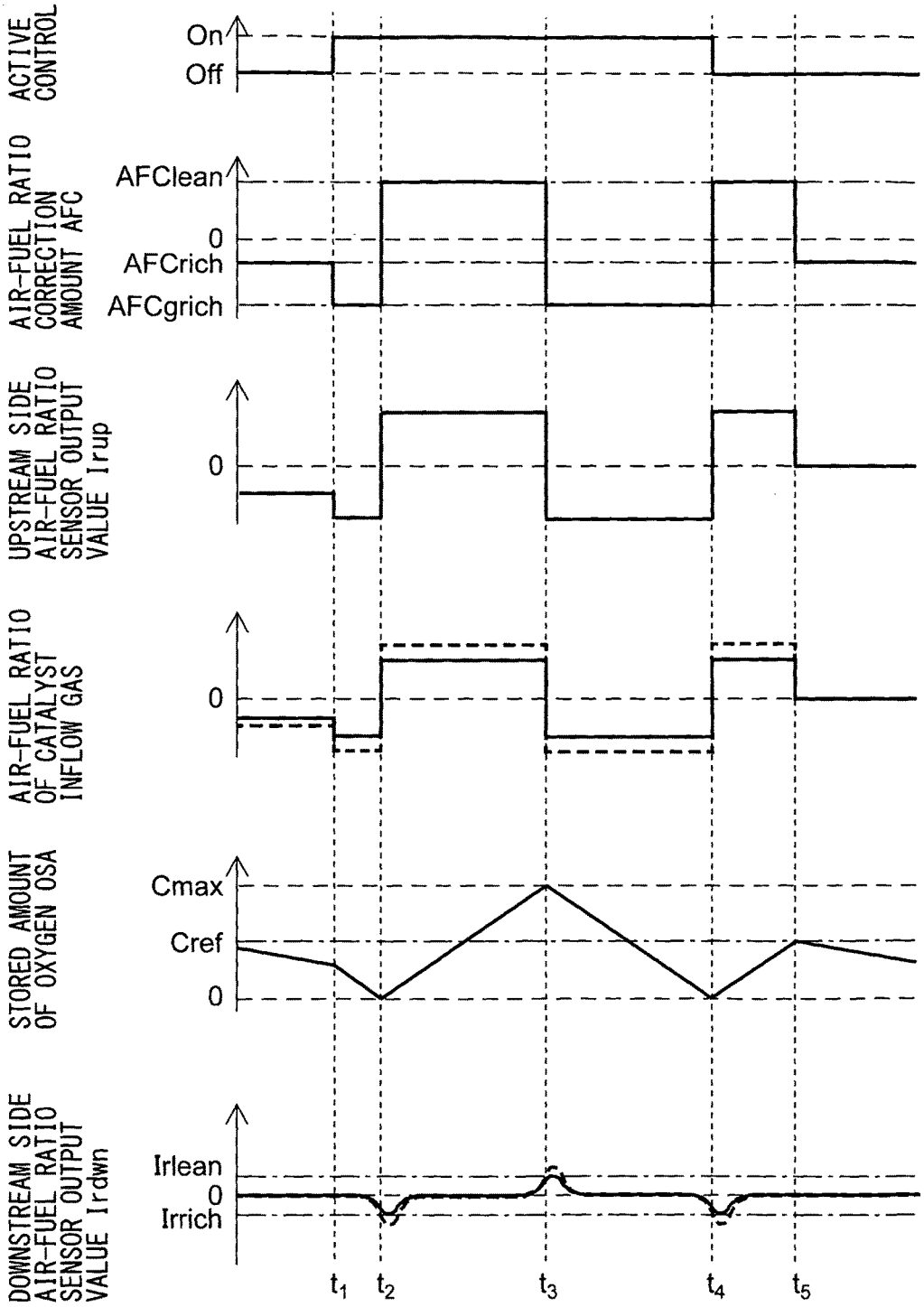
FIG. 11 is a time chart of the air-fuel ratio correction amount etc. when performing active air-fuel ratio control.

In the meantime, for example, the case where the output current Irup of the upstream side air-fuel ratio sensor 40 (absolute value) becomes a value larger than the value which should inherently be output, due to error, will be considered. In this case, since feedback control is performed based on the output current Irup of the upstream side air-fuel ratio sensor 40, as shown in FIG. 11, the output current Irup of the upstream side air-fuel ratio sensor 40 follows the same trend as when no error occurs in the output current Irup shown in FIG. 10. However, the actual air-fuel ratio of the exhaust gas flowing into the upstream side exhaust purification catalyst 20 becomes a value closer to the stoichiometric air-fuel ratio side as shown by the solid line in the figure, compared with when error does not occur in the output current Irup shown by the broken line in the figure. That is, the actual air-fuel ratio of the exhaust gas flowing into the upstream side exhaust purification catalyst 20 becomes smaller in rich degree and lean degree. As a result, when the stored amount of oxygen OSA of the upstream side exhaust purification catalyst 20 becomes substantially zero, the exhaust gas flowing around the downstream side air-fuel ratio sensor 41 becomes smaller in rich degree of the air-fuel ratio. For this reason, the output current Irdwn of the downstream side air-fuel ratio sensor 41 becomes smaller in absolute value as shown by the solid line in figure, compared with when there is no error in the output current Irup of the upstream side air-fuel ratio sensor 40 shown by the broken line in the figure.

Figure 12:
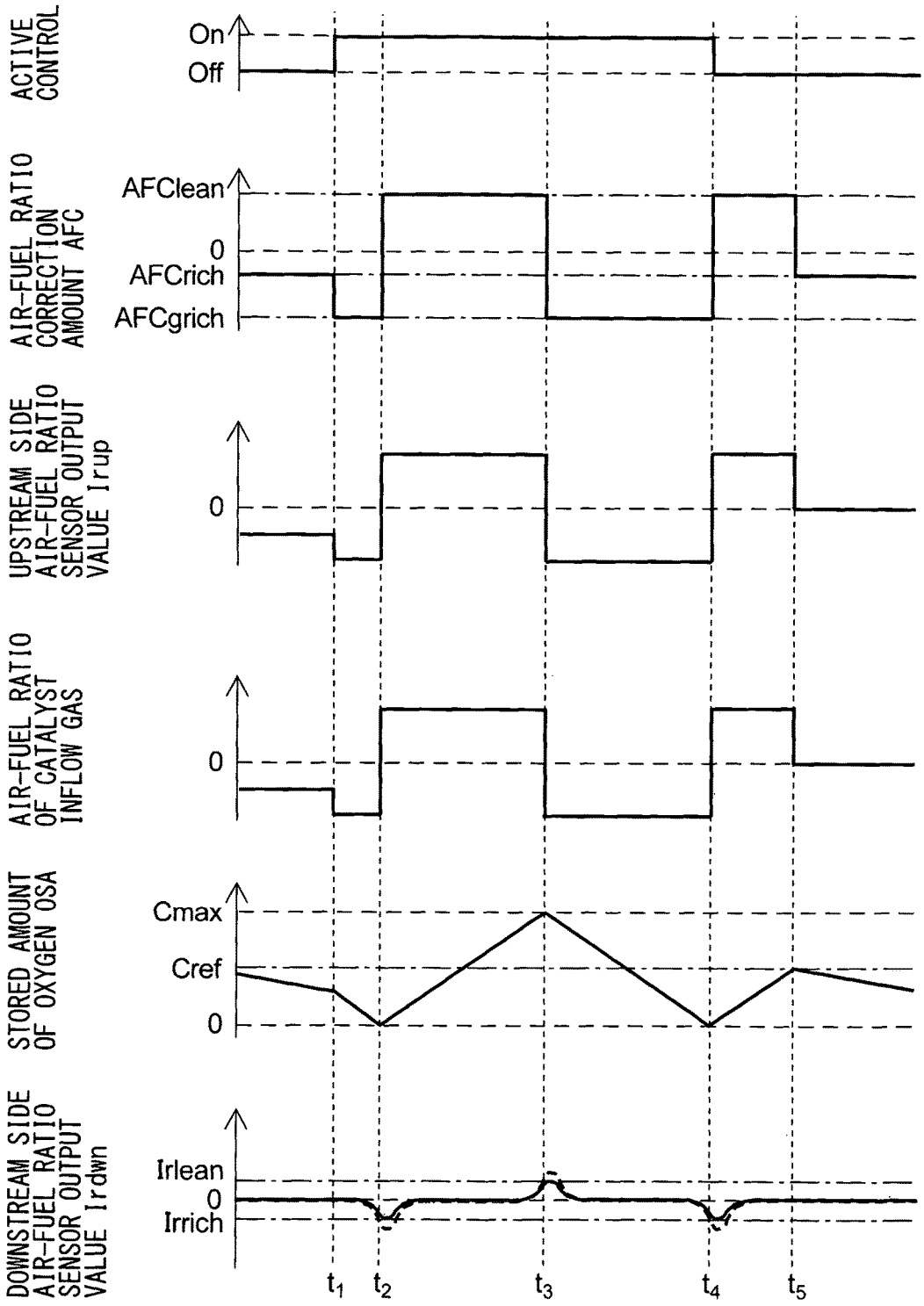
FIG. 12 is a time chart of the air-fuel ratio correction amount etc. when performing active air-fuel ratio control.

Next, the case where the output current Irdwn of the downstream side air-fuel ratio sensor 41 (absolute value) becomes a value smaller than the value which should inherently be output, due to error, will be considered. In this case, the output current Irdwn of the downstream side air-fuel ratio sensor 41 becomes smaller in absolute value as shown by the solid line in FIG. 12, compared with when there is no error in the output current Irdwn shown by the broken line in FIG. 12.

Figure 13:
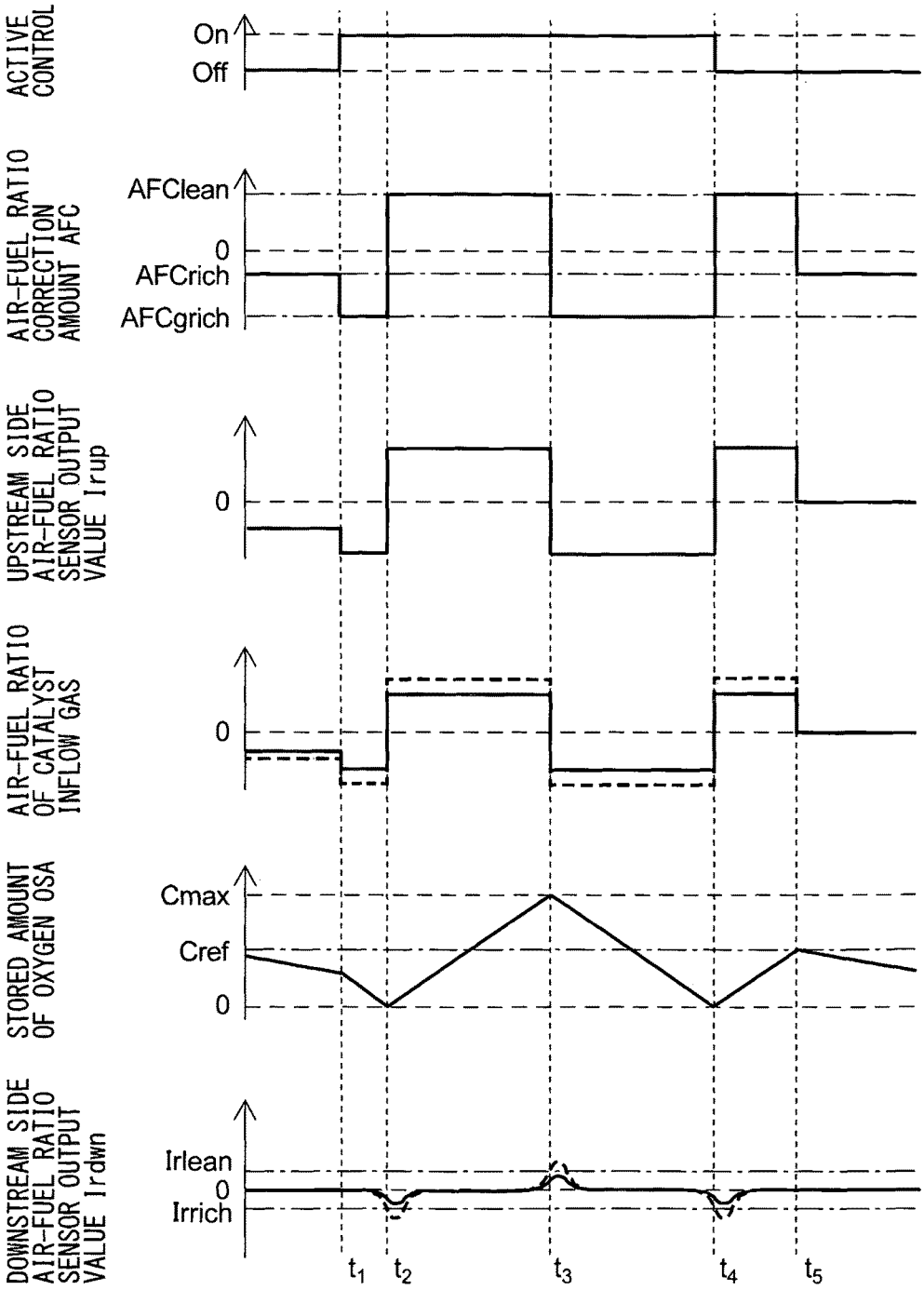
FIG. 13 is a time chart of the air-fuel ratio correction amount etc. when performing active air-fuel ratio control.

FIG. 13 shows the case where the output current Irup of the upstream side air-fuel ratio sensor 40 (absolute value) becomes a value larger than the value which should inherently be output due to error and the output current Irdwn of the downstream side air-fuel ratio sensor 41 (absolute value) becomes a value smaller than the value which should inherently be output due to error. In such a case, the output current Irdwn of the downstream side air-fuel ratio sensor 41 (absolute value) becomes an extremely small value and no longer reaches the rich judgment reference value Irrich or the lean judgment reference value Irlean. Here, as explained above, the air-fuel ratio correction amount AFC is switched when the output current Irdwn of the downstream side air-fuel ratio sensor 41 reaches the rich judgment reference value Irrich or the lean judgment reference value Irlean. Therefore, in the above-mentioned such case, the air-fuel ratio correction amount AFC is not switched and the air-fuel ratio correction amount AFC is fixed to the active rich set correction amount AFCgrich or active lean set correction amount AFCglean (note that, in FIG. 13, for comparison of FIG. 11 to FIG. 13, the example is shown of switching the air-fuel ratio correction amounts AFC at the times $t_2$, $t_3$, $t_4$). In this case, not only it is not possible to calculate the maximum storable oxygen amount Cmax of the upstream side exhaust purification catalyst 20, but also deterioration of the exhaust emission may be invited.

Further, the same can be said not only in diagnosis of the upstream side exhaust purification catalyst 20 for abnormality, but also in the above-mentioned basic air-fuel ratio control. When error occurs in both the upstream side air-fuel ratio sensor 40 and the downstream side air-fuel ratio sensor 41, for example, at the timing of the time $t_2$ or $t_5$ in FIG. 6, the output current Irdwn of the downstream side air-fuel ratio sensor 41 no longer reaches the rich judgment reference value Irrich.

<Diagnosis of Air-Fuel Ratio Sensors for Abnormality>

Therefore, in an embodiment of the present invention, in addition to the above-mentioned basic diagnosis of the air-fuel ratio sensors 40 and 41 for abnormality, additional diagnosis of abnormality is performed. This additional diagnosis of abnormality is also performed after the start of fuel cut control in the same way as the above-mentioned basic diagnosis of abnormality.

As shown in FIG. 7, after the start of fuel cut control, from the time $t_4$ on, the output current Irup of the upstream side air-fuel ratio sensor 40 converges, while from the time $t_5$, the output current Irdwn of the downstream side air-fuel ratio sensor 41 converges. In the present embodiment, the difference ΔIr between the thus converged output current Irup of the upstream side air-fuel ratio sensor 40 and output current Irdwn of the downstream side air-fuel ratio sensor 41 (below, referred to as the "upstream-downstream difference") is calculated. Further, when the thus calculated upstream-downstream difference ΔIr is within the range of normal difference (upper limit value of difference Dup or less and lower limit of difference Ddwn or more), so long as they are not judged abnormal in the above-mentioned basic diagnosis of abnormality, it is judged that the two air-fuel ratio sensors 40 and 41 have not become abnormal. On the other hand, when the upstream-downstream difference ΔIr is outside the range of normal difference, it is judged that at least one of the upstream side air-fuel ratio sensor 40 and downstream side air-fuel ratio sensor 41 has become abnormal. Further, in the present embodiment, the extent of the range of normal difference (Dup-Ddwn) is narrower than the extent of the range of normal judgment (Irulim-Irllim).

Figure 14:
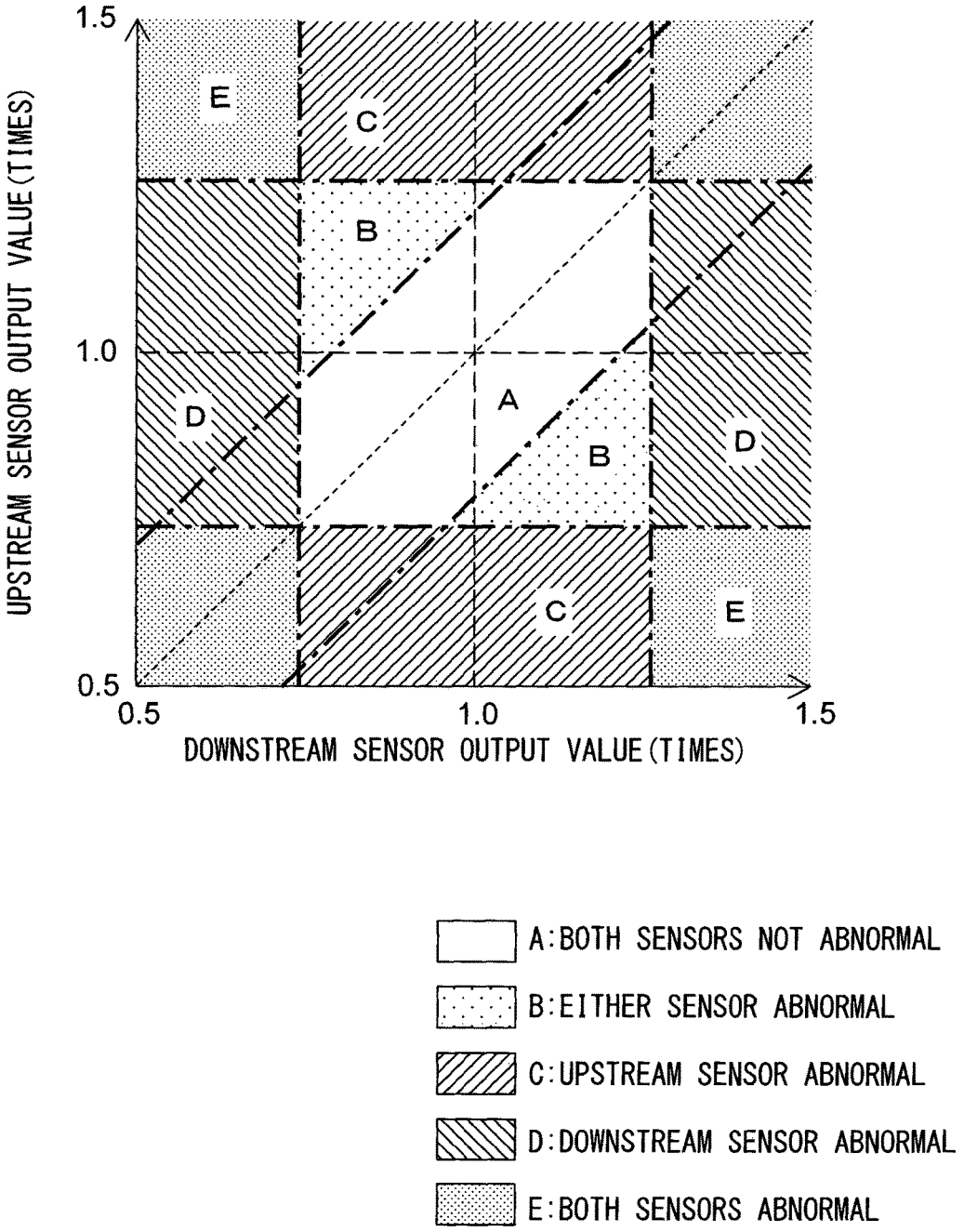
FIG. 14 is a view which shows a relationship between output currents of the air-fuel ratio sensors and judgment of abnormality.

FIG. 14 is a view showing the relationship between the output currents of the air-fuel ratio sensors 40 and 41 when the output currents of the air-fuel ratio sensors converge after the start of fuel cut control, and the judgment of abnormality. In the figure, the output currents of the air-fuel ratio sensors 40 and 41 show the ratios with respect to the normal output values during fuel cut control (therefore, in the figure, 1.0 indicates the normal output value). When, according to the above-mentioned basic diagnosis of abnormality, the output currents of both of the air-fuel ratio sensors 40 and 41 are within the regions C, D, and E in the figure, it is judged that these air-fuel ratio sensors 40 and 41 are abnormal. On the other hand, when, according to the additional diagnosis of abnormality, the output currents of both of the air-fuel ratio sensors 40 and 41 are in the region B in the figure, it is judged that these air-fuel ratio sensors 40 and 41 are abnormal.

Figure 15:
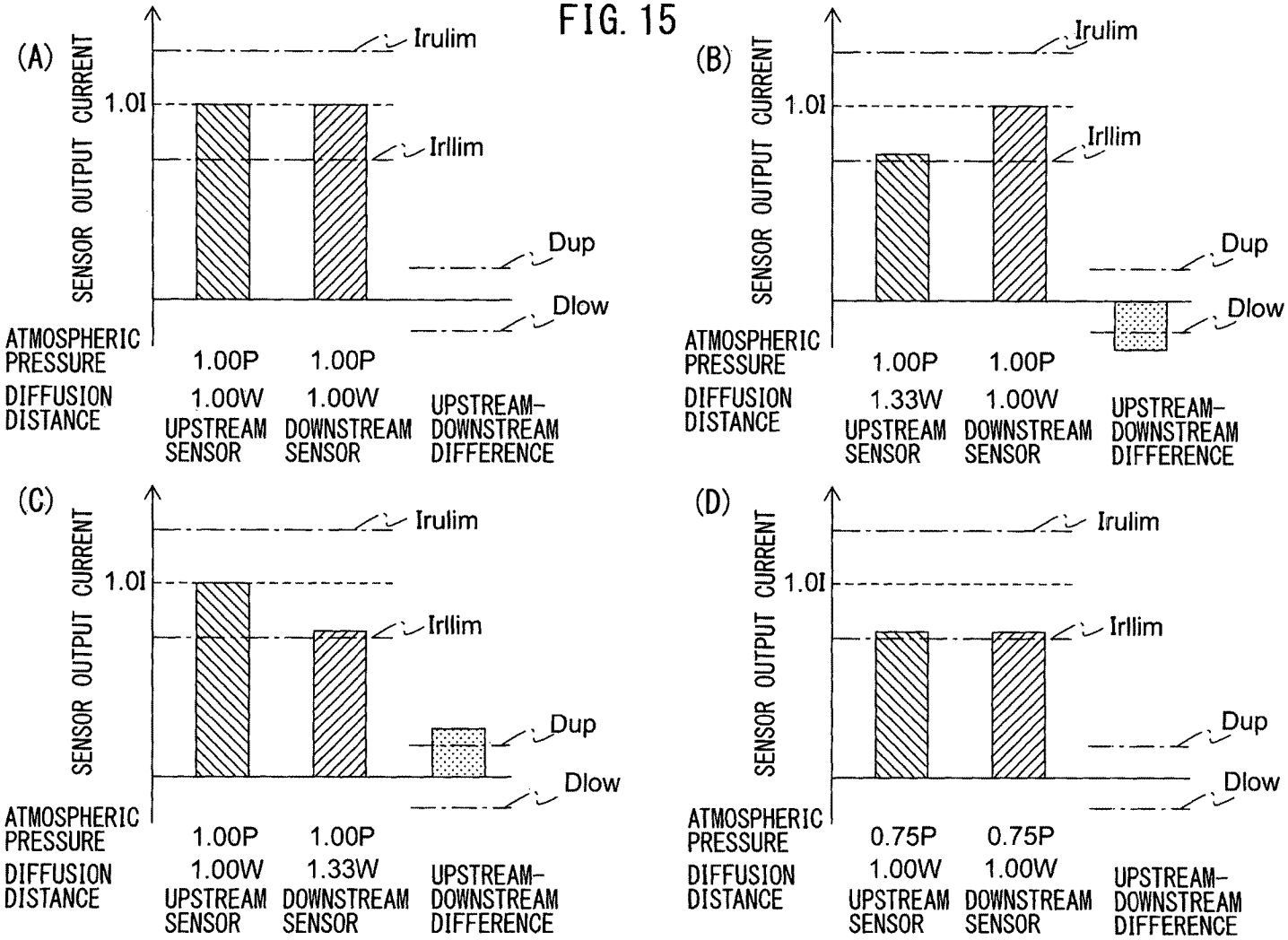
FIGS. 15A to 15D are views which shows a relationship between an atmospheric pressure and a diffusion distance at a diffusion regulation layer and the output current of an air-fuel ratio sensor.

FIGS. 15A to 15D are views showing the relationship between the atmospheric pressure and diffusion distances in the diffusion regulation layers, and the output currents of the air-fuel ratio sensors. FIG. 15A shows the output currents of the air-fuel ratio sensors when the atmospheric pressure is P (for example, 1 atm) and the diffusion distances of both of the air-fuel ratio sensors 40 and 41 are W (for example, the design value) (that is, when there is no error in the output currents of the air-fuel ratio sensors). In the example shown in FIG. 15A, in the same way as FIG. 9, the output currents of the air-fuel ratio sensors become the steady state output value I. Further, since the output currents of both of the air-fuel ratio sensors 40 and 41 are equal, the upstream-downstream difference ΔIr between these output currents becomes 0. Therefore, since the upstream-downstream difference ΔIr of the output currents is within the range of normal difference, it is judged that these air-fuel ratio sensors 40 and 41 have not become abnormal.

FIG. 15B shows the case where the atmospheric pressure is P and error occurs in only the output current of the upstream side air-fuel ratio sensor 40. Specifically, the diffusion distance of the upstream side air-fuel ratio sensor 40 becomes 1.33 times of W. In this case, the output current of the upstream side air-fuel ratio sensor 40 becomes 0.75 time of I. As explained above, the range of normal judgment (Irulim to Irllim) is set relatively broad, and therefore upstream side air-fuel ratio sensor 40 is not judged abnormal in the above-mentioned basic diagnosis of abnormality. On the other hand, the upstream-downstream difference ΔIr of the output current of the upstream side air-fuel ratio sensor 40 minus the output current of the downstream side air-fuel ratio sensor 41 is relatively large. In addition, the range of normal difference (Dup to Dlow) is narrower than the range of normal judgment. For this reason, the upstream-downstream difference ΔIr of the output currents becomes a value outside the range of normal difference. Therefore, according to the additional diagnosis of abnormality, it is judged that one of the two air-fuel ratio sensors 40 and 41 has become abnormal.

FIG. 15C shows the case where the atmospheric pressure is P and error occurs in only the output current of the downstream side air-fuel ratio sensor 41. Specifically, the diffusion distance of the downstream side air-fuel ratio sensor 41 becomes 1.33 times W. In this case, the output current of the downstream side air-fuel ratio sensor 41 becomes 0.75 time of I. In this case as well, the downstream side air-fuel ratio sensor 41 is not judged abnormal in the above-mentioned basic diagnosis of abnormality. On the other hand, the upstream-downstream difference ΔIr is relatively large and becomes a value outside the range of normal difference. Therefore, according to the additional diagnosis of abnormality, in the state shown by FIG. 15C as well, it is judged that one of the two air-fuel ratio sensors 40 and 41 has become abnormal.

FIG. 15D shows the case where the atmospheric pressure is 0.75 time of P and there is no error in both of the air-fuel ratio sensors 40 and 41. In this case, the output currents of the two air-fuel ratio sensors 40 and 41 become 0.75 time of I. Therefore, in this case as well, both of the air-fuel ratio sensors 40 and 41 are not judged abnormal in the above-mentioned basic diagnosis of abnormality. In addition, the upstream-downstream difference ΔIr also becomes zero, and therefore becomes a value in the range of normal difference. Therefore, in the present embodiment, in the state which is shown by FIG. 15D, it is judged that neither of the two air-fuel ratio sensors 40 and 41 has become abnormal.

From the above, according to the diagnosis of abnormality of the above embodiment, when error occurs in the output current of the air-fuel ratio sensor 40 or 41, even if the output currents of the air-fuel ratio sensors 40 and 41 are in the range of normal judgment, it can be judged that the air-fuel ratio sensor 40 or 41 has become abnormal. On the other hand, when the output currents of these air-fuel ratio sensors 40 and 41 change along with change of the atmospheric pressure, it is judged that these air-fuel ratio sensors 40 and 41 have not become abnormal. Therefore, according to the present embodiment, it is possible to more accurately diagnose the air-fuel ratio sensors 40 and 41 for abnormality.

Further, as shown in FIG. 13, when the output current Irup of the upstream side air-fuel ratio sensor 40 and the output current Irdwn of the downstream side air-fuel ratio sensor 41 deviate in opposite directions from each other, the upstream-downstream difference ΔIr becomes a large value. Therefore, in such a case as well, it is judged that one of the two air-fuel ratio sensors 40 and 41 has become abnormal. For this reason, according to the present embodiment, it is possible to keep the maximum storable oxygen amount Cmax from not being able to be calculated and the exhaust emission from deteriorating like in the example which is shown in FIG. 13.

Note that, in the above embodiment, after the start of fuel cut control and after the output currents of the upstream side air-fuel ratio sensor 40 and downstream side air-fuel ratio sensor 41 converge, the output currents are detected once and the values used as the basis for diagnosis of abnormality. However, after the output currents of these air-fuel ratio sensors 40 and 41 converge, it is also possible to detect the output currents over a certain time period and perform diagnosis of abnormality based on the average values of the detected output currents.

Further, in the above embodiment, after the start of fuel cut control and after the output currents of the air-fuel ratio sensors 40 and 41 converge, the output currents are detected. In the present embodiment, when, for example, the amounts of change of the air-fuel ratio sensors 40 and 41 per unit time are predetermined amounts or less, it is judged that the output currents of the air-fuel ratio sensors 40 and 41 have converged. Alternatively, it is also possible to judge that the output currents of the air-fuel ratio sensors 40 and 41 have converged when the elapsed time after the start of fuel cut control reaches a predetermined reference time or when the total intake air amount after the start of fuel cut control reaches a predetermined reference amount. The reference time and the reference amount are set to a longer time and larger amount than the time and amount which are normally taken for the output currents of the air-fuel ratio sensors 40 and 41 to converge after the start of fuel cut control.

Further, in the above embodiment, additional diagnosis of abnormality is performed based on the difference ΔIr of the output current Irup of the upstream side air-fuel ratio sensor 40 and the output current Irdwn of the downstream side air-fuel ratio sensor 41. However, it is also possible to perform additional diagnosis of abnormality based on the ratio of the output current Irup and the output current Irdwn. In this case as well, when the ratio of the output current Irup and the output current Irdwn is within a predetermined range of normal ratio, it is judged that the both of air-fuel ratio sensors 40 and 41 have not become abnormal. On the other hand, when this ratio is outside the range of normal ratio, it is judged that at least one of the air-fuel ratio sensors 40 and 41 has become abnormal.

<Flow Chart>

Figure 16:
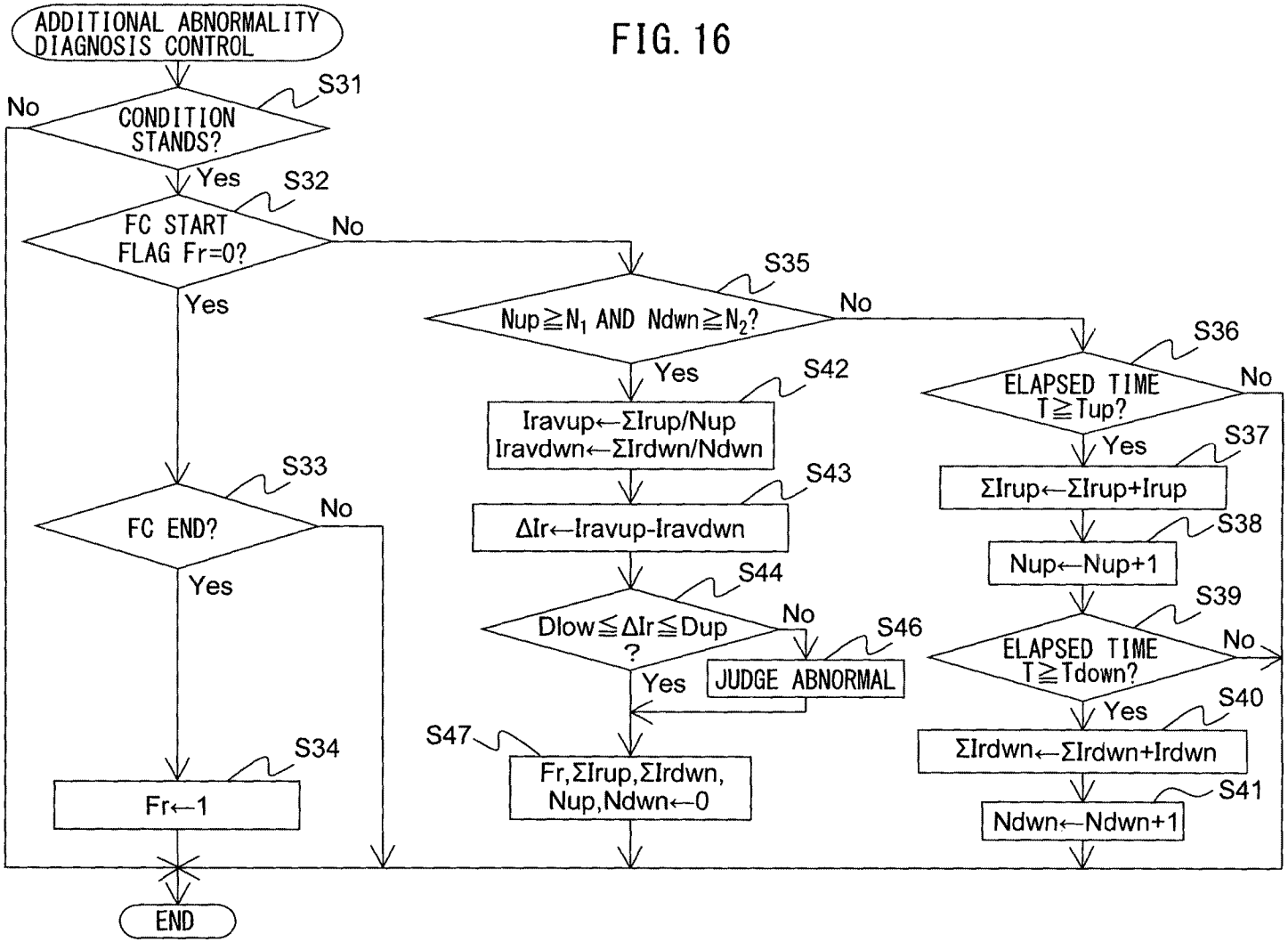
FIG. 16 is a flow chart which shows a control routine of additional abnormality diagnosis control of an air-fuel ratio sensor.

FIG. 16 is a flow chart showing the control routine of the above-mentioned additional abnormality diagnosis control of the air-fuel ratio sensors 40 and 41. The illustrated control routine is performed by interruption at predetermined time intervals. In FIG. 16, step S31 to step S34 are similar to step S11 to step S14 of FIG. 8, and therefore explanations will be omitted.

When it is judged at step S32 that the FC start flag is set to "1", the routine proceeds to step S35. At step S35, it is judged if the upstream side detection number Nup is a predetermined number $N_1$ or more and the downstream side detection number Ndwn is $N_2$ or more. The upstream side detection number Nup and downstream side detection number Ndwn respectively show the numbers of times the output currents are detected after the upstream side air-fuel ratio sensor 40 and downstream side air-fuel ratio sensor 41 converge. If the upstream side detection number Nup is less than $N_1$ or the downstream side detection number Ndwn is less than $N_2$, the routine proceeds to step S36.

At step S36, it is judged if the elapsed time T from when the fuel cut control was started is a predetermined reference time Tup or more. Note that, this reference time Tup is set to a time of at least the time normally taken after the start of fuel cut control for the output current of the upstream side air-fuel ratio sensor 40 to converge. When it is judged that the elapsed time T is less than the reference time Tup, the control routine is ended. On the other hand, when it is judged at step S36 that the elapsed time T is the reference time Tup or more, the routine proceeds to step S37. At step S37, the current output current Irup of the upstream side air-fuel ratio sensor 40 is added to the upstream side cumulative value ΣIrup to give the new upstream side cumulative value ΣIrup. Next, at step S38, the upstream side detection number Nup is incremented by 1.

After that, at step S39, it is judged if the elapsed time T is a predetermined reference time Tdwn (value larger than Tup) or more. When it is judged that the elapsed time T is less than the reference time Tdwn, the control routine is ended. On the other hand, when it is judged at step S39 that the elapsed time T is the reference time Tdwn or more, the routine proceeds to step S40. At step S40, the current output current Irdwn of the downstream side air-fuel ratio sensor 41 is added to the downstream side cumulative value ΣIrdwn to give the new downstream side cumulative value ΣIrdwn. Next, at step S41, the downstream side detection number Ndwn is incremented by 1.

After that, the output currents Irup and Irdwn are repeatedly added. When the upstream side detection number Nup becomes a predetermined number $N_1$ or more and the downstream side detection number Ndwn becomes $N_2$ or more, at the next control routine, the routine proceeds to step S35 to step S42. At step S42, the upstream side cumulative value ΣIrup which was calculated at step S37 is divided by the upstream side detection number Nup which was calculated at step S38 to obtain the average value Iravup of the upstream side output current. In addition, the downstream side cumulative value ΣIrdwn which was calculated at step S40 is divided by the downstream side detection number Ndwn which was calculated at step S41 to obtain the average value Iravdwn of the downstream side output current. Next, at step S43, the average value Iravup of the upstream side output current is decreased by the average value Iravdown of the downstream side output current to obtain the upstream-downstream difference ΔIr.

Next, at step S44, it is judged if the upstream-downstream difference ΔIr calculated at step S43 is in the range of normal difference (Dlow or more and Dup or less). When it is judged that the upstream-downstream difference ΔIr is in the range of normal difference, the routine proceeds to step S47. On the other hand, when it is judged at step S44 that the upstream-downstream difference ΔIr is outside the range of normal difference, the routine proceeds to step S46. At step S46, even if judged normal at the abnormality diagnosis control shown in FIG. 8, it is judged that at least one of the upstream side air-fuel ratio sensor 40 and downstream side air-fuel ratio sensor 41 has become abnormal. Next, at step S47, the FC start flag Fr, upstream side cumulative value ΣIrup, downstream side cumulative value ΣIrdwn, upstream side detection number Nup, and downstream side detection number Ndwn are reset to zero and the control routine is ended.

Note that, in the above embodiment, when the upstream side detection number Nup is a predetermined number $N_1$ or more and the downstream side detection number Ndwn is $N_2$ or more, additional diagnosis of abnormality is performed. However, for example, it is also possible to perform the additional diagnosis of abnormality when the elapsed time from when the upstream side cumulative value ΣIrup and the downstream side cumulative value ΣIrdwn started to be cumulatively added becomes a predetermined time or more, or when the upstream side cumulative value ΣIrup or downstream side cumulative value ΣIrdwn becomes a predetermined value or more.

Second Embodiment

Next, referring to FIG. 17, an abnormality diagnosis system of a second embodiment of the present invention will be explained. The configuration and control in the abnormality diagnosis system of the second embodiment are basically the same as the configuration and control in the abnormality diagnosis system of the first embodiment. However, as shown in FIG. 17, in the abnormality diagnosis system of the second embodiment, the regions where it is judged that both of the air-fuel ratio sensors 40 and 41 have become abnormal differ from the regions in the abnormality diagnosis system of the first embodiment.

Figure 17:
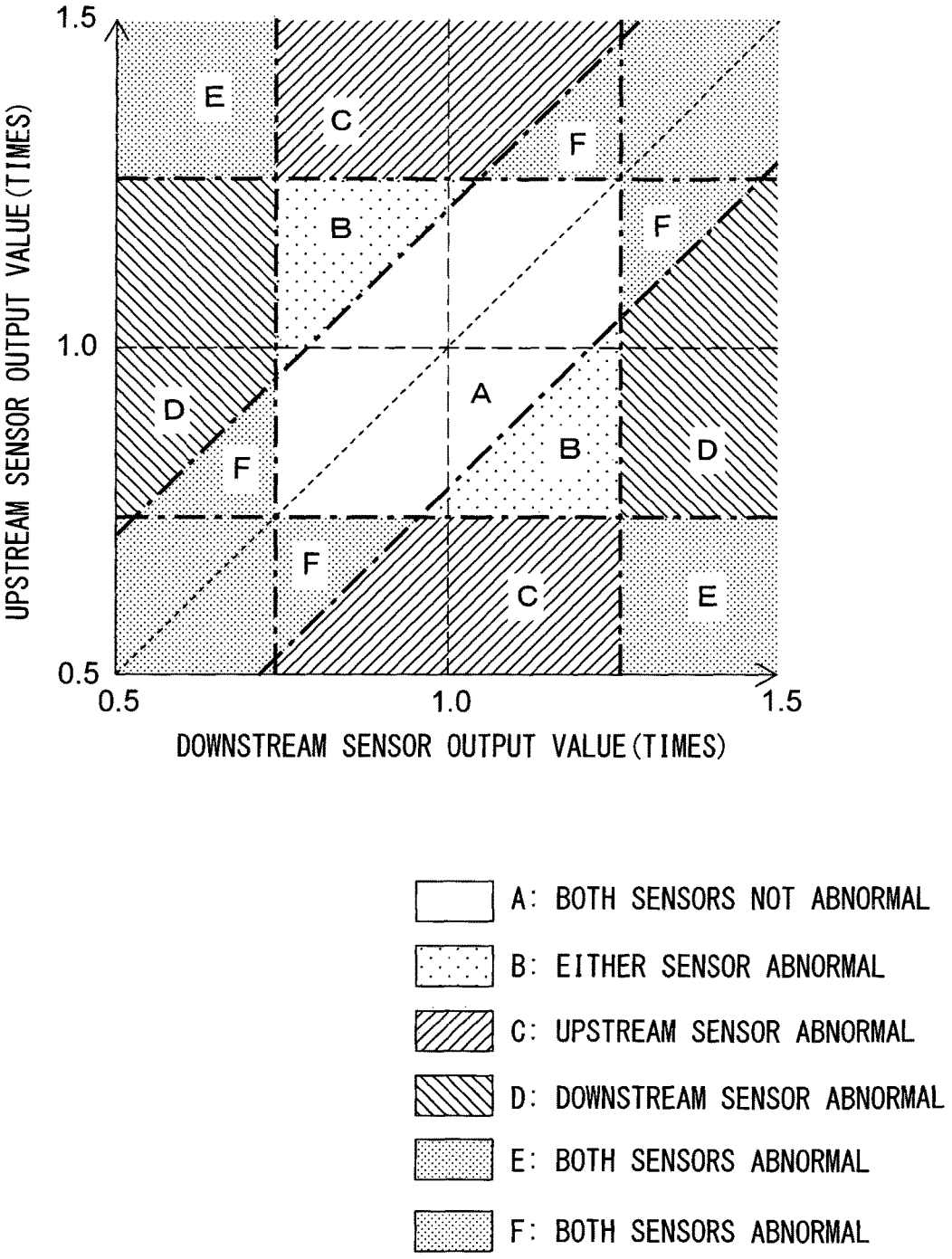
FIG. 17 is a view, similar to FIG. 14, which shows a relationship between output currents of the air-fuel ratio sensors and judgment of abnormality.

FIG. 17 shows the relationship between the output currents of the air-fuel ratio sensors 40 and 41 and the judgment of abnormality when the output currents of the air-fuel ratio sensors converge after the start of fuel cut control in the present embodiment and is similar to FIG. 14. As will be understood from FIG. 17, in the present embodiment, in the region F in the figure, it is judged that the two air-fuel ratio sensors 40 and 41 have become abnormal. That is, in the example shown in FIG. 14, for the region corresponding to the region F, it is judged that only one of the upstream side air-fuel ratio sensor 40 and downstream side air-fuel ratio sensor 41 has become abnormal, while in this region in the present embodiment, it is judged that both have become abnormal.

In the region F of FIG. 17, after the start of fuel cut control, only one of the output current Irup of the upstream side air-fuel ratio sensor 40 and the output current Irdwn of the downstream side air-fuel ratio sensor 41 is a value outside the range of normal judgment. In addition, in the region F, the upstream-downstream difference ΔIr of the output current Irup and the output current Irdwn is a value within the range of normal difference. Here, the upstream-downstream difference ΔIr being in the range of normal difference means that the output current Irup and the output current Irdwn are relatively close values. That is, it means the diffusion distance of the upstream side air-fuel ratio sensor 40 and the diffusion distance of the downstream side air-fuel ratio sensor 41 are close values. Further, the output current of one of the air-fuel ratio sensors 40 and 41 being outside the range of normal judgment means that the diffusion distances of the air-fuel ratio sensors 40 and 41 are values off from the ideal values. Therefore, the output current of one of the air-fuel ratio sensors 40 and 41 being outside the range of normal judgment enables it to be judged that the diffusion distance of the other of the air-fuel ratio sensors 40 and 41 is a value off from the ideal value. For this reason, in the present embodiment, in the region F as well, it is judged that the both of the air-fuel ratio sensors 40 and 41 have become abnormal. According to the present embodiment, due to this, it is possible to suitably diagnose the two air-fuel ratio sensors 40 and 41 for abnormality.

REFERENCE SIGNS LIST

1 engine body
5 combustion chamber
7 intake port
9 exhaust port
19 exhaust manifold
20 upstream side exhaust purification catalyst
24 downstream side exhaust purification catalyst
31 ECU
40 upstream side air-fuel ratio sensor
41 downstream side air-fuel ratio sensor

The invention claimed is:

1. An abnormality diagnosis system comprising: an internal combustion engine, the internal combustion engine including an exhaust purification catalyst arranged in an exhaust passage of the internal combustion engine; an upstream side air-fuel ratio sensor which is arranged at an upstream side of said exhaust purification catalyst in an exhaust flow direction and which detects an air-fuel ratio of exhaust gas flowing into said exhaust purification catalyst; and a downstream side air-fuel ratio sensor which is arranged at a downstream side of said exhaust purification catalyst in an exhaust flow direction and which detects an air-fuel ratio of exhaust gas flowing out from said exhaust purification catalyst, wherein the upstream side air-fuel ratio sensor and the downstream side air-fuel ratio sensor are configured so that outputs of the upstream side air-fuel ratio sensor and the downstream side air-fuel ratio sensor change depending on atmospheric pressure during fuel cut control in which fuel fed to inside of the internal combustion engine is stopped; and an electronic control unit (ECU) including a processor for executing programs stored in memory of the ECU, and input and output ports connected to the upstream side air-fuel ratio sensor and the downstream side air-fuel ratio sensor, the ECU configured to:

control an amount of fuel fed to the internal combustion engine based on outputs of the upstream side air-fuel ratio sensor and the downstream side air-fuel ratio sensor; and judge that at least one of the air-fuel ratio sensors has become abnormal when a difference between an output value of said upstream side air-fuel ratio sensor and an output value of said downstream side air-fuel ratio sensor becomes outside a predetermined range of normal difference during the fuel cut control, the predetermined range of normal difference is a range of difference in the output value between the upstream side air-fuel ratio sensor and the downstream side air-fuel ratio sensor, which can be generated when both of the upstream side air-fuel ratio sensor and the downstream side air-fuel ratio sensor are normal, wherein the ECU judges that one of the upstream side air-fuel ratio sensor and the downstream side air-fuel ratio sensor has become abnormal when the output value of the one of the upstream side air-fuel ratio sensor and the downstream side air-fuel ratio sensor is outside a predetermined range of normal judgment during the fuel cut control, the predetermined range of normal judgment is a range which is equal to or less than a normal upper limit of the output value of the upstream side air-fuel ratio sensor and the downstream side air-fuel ratio sensor and equal to or larger than a normal lower limit of the output value of the upstream side air-fuel ratio sensor and the downstream side air-fuel ratio sensor; and said predetermined range of normal difference is set narrower than said predetermined range of normal judgment.

2. The abnormality diagnosis system according to claim 1, wherein when the difference or ratio of the output values of the upstream side air-fuel ratio sensor and the downstream side air-fuel ratio sensor is within said predetermined range of normal difference and an output value of one of the upstream air-fuel ratio sensor and the downstream air-fuel ratio sensor is out of said predetermined range of normal judgment and it is diagnosed that one of said upstream side air-fuel ratio sensor and said downstream side air-fuel ratio sensor has become abnormal, the ECU judges that the other of the upstream side air-fuel ratio sensor and the downstream side air-fuel ratio sensor has also become abnormal.

* * * * *